US007832658B2

(12) United States Patent
Kaneko et al.

(10) Patent No.: US 7,832,658 B2
(45) Date of Patent: Nov. 16, 2010

(54) LIQUID REPELLENT STRUCTURE, METHOD OF PRODUCING THE SAME, LIQUID EJECTION HEAD AND PROTECTIVE FILM

(75) Inventors: Yasuhisa Kaneko, Kanagawa (JP); Koju Ito, Kanagawa (JP); Hidekazu Yamazaki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 884 days.

(21) Appl. No.: 11/645,719

(22) Filed: Dec. 27, 2006

(65) Prior Publication Data

US 2007/0160790 A1 Jul. 12, 2007

(30) Foreign Application Priority Data

Dec. 27, 2005 (JP) ..... 2005-375709

(51) Int. Cl.
*B05B 1/08* (2006.01)

(52) U.S. Cl. ..... 239/102.2

(58) Field of Classification Search ..... 239/102.1, 239/102.2, 690, 690.1, 696, 589, 548, 554, 239/558, 566, 553.3, 172, 173, DIG. 19; 428/141, 172, 173
See application file for complete search history.

(56) References Cited

U.S. PATENT DOCUMENTS 7,328,976 B2 * 2/2008 Silverbrook ..... 347/54

FOREIGN PATENT DOCUMENTS

| | | | |
|---|---|---|---|
| JP | 2000-226570 A | | 8/2000 |
| JP | 2001-157574 A | | 6/2001 |
| JP | 2005-23122 A | | 1/2005 |
| JP | 2005023122 A | * | 1/2005 |

OTHER PUBLICATIONS

Yabu et al., Langmuir 3, No. 8, Feb. 18, 2005, vol. 21, pp. 3235-3237.

* cited by examiner

*Primary Examiner*—Davis Hwu
(74) *Attorney, Agent, or Firm*—Birch, Stewart, Kolasch & Birch, LLP

(57) ABSTRACT

The liquid repellent structure includes a support, and a honeycomb-patterned film and a coating film on the honeycomb-patterned film or a liquid repellent film. The method of producing the structure applies a solution of an organic compound in an organic solvent onto the support, places the support in an atmosphere containing water vapor to form water droplets on a surface of the solution film, evaporates the organic solvent and the droplets to form the honeycomb-patterned film, and forms the coating film made of a fluorine-containing material on a surface of the honeycomb-patterned film or etches the honeycomb-patterned film to form a second honeycomb-patterned film. The liquid ejection head includes an ejection substrate having the liquid repellent structure. The protective film includes a support base and the liquid repellent structure.

6 Claims, 15 Drawing Sheets

LIQUID REPELLENT STRUCTURE, METHOD OF PRODUCING THE SAME, LIQUID EJECTION HEAD AND PROTECTIVE FILM

The entire contents of documents cited in this specification are incorporated herein by reference.

BACKGROUND OF THE INVENTION

The present invention relates to a liquid repellent structure exhibiting high repellency with respect to liquids such as water, an organic solvent and oil, a method of producing the liquid repellent structure that ensures high productivity, a liquid ejection head using the liquid repellent structure and a stain-resistant protective film.

As for water repellent materials and surface structures obtained from such materials, a contact angle of at least 90° is obtained by using a fluorine-based material. However, a material and a structure exhibiting repellency with respect to a liquid having a low surface tension such as an organic solvent or oil have not been fully examined yet.

Most of the conventionally known repellent materials mainly exhibit repellency with respect to water (also called water repellency). Water repellent materials have been used for rain gear, household utensils such as kitchen utensils, industrial equipment, and the like.

A repellent material is industrially applied to an inkjet system with which finely divided ink droplets are ejected and sprayed onto and adhered to recording paper to perform recording. In the inkjet system, it is very important to form a repellent film around each ejection port in order to enhance the ejection performance.

A super-water-repellent polytetrafluoroethylene (PTFE) film formed by nickel eutectoid plating and having a contact angle in excess of 150° with respect to water has been realized as the water repellent material.

It is important to study both of the properties of a material (material having a low surface tension) and the surface structure in order to improve repellency and various studies have been conventionally made (see, for example, JP 2000-226570 A).

JP 2000-226570 A discloses a water repellent structure obtained by forming a water repellent film with a thickness of about 100 nm on the surface of an uneven surface structure that was formed by photolithography on a surface of a substrate.

In addition to the water repellent structure described in JP 2000-226570 A, also is known a method of forming a honeycomb structure by evaporating finely divided water droplets formed on the surface of a repellent polymer by condensation (see, for example, JP 2001-157574 A).

JP 2001-157574 A discloses a honeycomb structure obtained by casting a solution of a biodegradable polymer and an amphipathic polymer in a hydrophobic organic solvent onto a substrate in an atmosphere with a relative humidity of 50 to 95%, causing condensation on the surface of the cast solution while gradually evaporating the organic solvent, and evaporating finely divided water droplets generated by the condensation.

Honeycomb structures having excellent water repellency have also been proposed (see JP 2005-23122 A and H. Yabu, et al., "Superhydrophobic and Lipophobic Properties of Self-Organized Honeycomb and Pincushion Structures", Langmuir 3, 8, 2005, 21, 3235-3237). The document of H. Yabu, et al. is hereinafter referred to simply as "Non-Patent Document 1".

SUMMARY OF THE INVENTION

However, the water repellent structure of JP 2000-226570 A employs photolithography to form the uneven surface structure. Therefore, the water repellent structure requires an expensive production device and a clean environment for its production. Furthermore, the production process requires patterning, which involves an increase in the number of steps, thus increasing the time and cost for its production. In the water repellent structure of JP 2000-226570 A, the water repellent film formed on the uneven surface structure has a thickness as small as about 100 nm and the thickness is not sufficient to achieve high abrasion resistance and causes non-negligible influences of its deterioration with time.

The water repellent structure of JP 2000-226570 A employs photolithography. Therefore, the region exposed by one exposing operation is limited, and the patterning operation is hard, for example, in the case where the water repellent structure with a large area is to be formed on a sheet-like support.

Water repellency is not taken into consideration in the honeycomb structure disclosed in JP 2001-157574 A.

The water repellent film in each of JP 2005-23122 A and Non-Patent Document 1 uses a fluorine-containing solution in an organic solvent, so the conditions for producing the honeycomb structure and the composition of the fluorine-containing solution in an organic solvent are limited. Therefore, it is also hard to produce the water repellent films in JP 2005-23122 A and Non-Patent Document 1 at low cost due to a narrow margin of the production conditions.

In addition, it has been conventionally known that an organic solvent, oil, or the like having adhered to a surface may deteriorate the repellency. Therefore, a material exhibiting repellency with respect to an organic solvent and oil has been desired.

At present, however, the material exhibiting repellency with respect to an organic solvent, oil, and the like has been rarely studied. This is mainly because the organic solvent and oil have a surface tension considerably lower than that of water, and sufficient repellency cannot be easily achieved.

The reason why repellency with respect to a material having a low surface tension such as an organic solvent or oil cannot be easily achieved will be described below in detail.

As shown in FIG. 17, the contact angle θ formed between a surface 150*a* of a smooth solid 150 and a liquid 152 placed thereon is represented by the following expression 1 showing the relationship among the surface tension $\gamma_L$ of the liquid 152, the surface tension $\gamma_S$ of the solid 150, and the interaction (interfacial tension) $\gamma_{SL}$ between the solid 150 and the liquid 152.

$$\gamma_S=\gamma_{SL}+\gamma_L\cdot\cos\theta \quad (1)$$

In addition, the solid-liquid interfacial tension $\gamma_{SL}$ is represented by the following expression 2.

$$\gamma_{SL}=\gamma_S+\gamma_L-2\sqrt{\gamma_S\gamma_L} \quad (2)$$

The following expression 3 is derived by combining the expressions 1 and 2. The expression 3 means that the contact angle showing repellency is derived from a magnitude relationship between the surface tension $\gamma_S$ of the solid and the surface tension $\gamma_L$ of the liquid.

$$\theta = \cos^{-1}\left(\sqrt{\frac{4\gamma_S}{\gamma_L}} - 1\right) \quad (3)$$

A contact angle of 90° or more is generally defined as exhibiting "repellency", while a contact angle of less than 90° is generally defined as exhibiting "lyophilic property" ("Kou Hassui Gijutsu no Saishin Doko" (Latest Trends in High Repellency Technique), TORAY RESEARCH CENTER, Inc., p 1). A relationship capable of realizing the repellency is represented by the following expression 4.

$$\gamma_S < \frac{\gamma_L}{4} \quad (4)$$

That is, the surface tension $\gamma_S$ of the solid must be equal to or less than one fourth of the surface tension $\gamma_L$ of the liquid. The surface tension of water is 74 mN/m. The surface tension $\gamma_S$ of the solid must be equal to or less than one fourth of 74 mN/m, that is, equal to or less than 19 mN/m in order that the solid may exhibit repellency with respect to water. Table 1 below shows the surface tension of each substance. Examples of a solid material having a surface tension of 19 mN/m or less include Teflon® and Cytop®, and each of the materials provides a contact angle θ of 90° or more.

TABLE 1

| Material | Surface tension (mN/m) |
|---|---|
| Perfluorolauric acid | 6 |
| Fluoroalkylsilane | 10 |
| Teflon ® | 18 |
| Cytop ® | 19 |
| Polytrifluoroethylene | 22 |
| Polyimide | 23 |
| Silicone (polydimethylsiloxane) | 24 |
| Polyvinylidene fluoride | 25 |
| Polyvinyl fluoride | 28 |
| Polyethylene | 31 |
| Polystyrene | 33 |
| PMMA | 39 |
| Polyvinylidene chloride | 40 |
| Polyethylene terephthalate | 43 |
| Nylon ® | 46 |
| Cellophane | 80 |

Meanwhile, an organic solvent, oil or the like has a surface tension much lower than that of water. For example, decane has a surface tension of 24 mN/m, so a solid having a surface tension of 6 mN/m or less is needed to exhibit repellency with respect to such liquid. An example of the solid includes perfluorolauric acid. In actuality, however, this solid is not practical because only a monomolecular film of the order of an atomic layer can be formed from the solid and because the solid exhibits no repellency with respect to water.

Introduction of a surface structure has been known as another method of improving repellency. Models for the surface structure are roughly classified into two models. One model is a Wentzel model shown in FIG. 18 in which microscopic irregularities 156 are formed on the surface of a solid 154 to increase the surface area to thereby increase the contact angle.

In FIG. 18, θ represents the true contact angle (contact angle θ when the surface is smooth (see FIG. 17)) and $\theta_f$ represents the apparent contact angle.

The relationship between the contact angle θ and the apparent contact angle $\theta_f$ is represented by the following expression 5. In the following expression 5, r represents a surface multiplication factor and is represented by a ratio between the true surface area and the apparent surface area.

$$\cos\theta_f = r\cdot\cos\theta \quad (5)$$

In the Wentzel model, one which is lyophilic becomes more lyophilic, and one which is repellent becomes more repellent.

FIG. 19 is a graph showing the relationship between the contact angle θ and the apparent contact angle $\theta_f$ in the Wentzel model in which the axis of ordinates indicates cos $\theta_f$ and the axis of abscissas indicates cos θ.

As shown in FIG. 19, in the Wentzel model, unless a material itself has a contact angle of 90° or more (cos θ<0) with respect to a target liquid, it is difficult to further increase the contact angle.

In addition, in the Wentzel model, a straight line L shown in FIG. 19 is obtained when the surface does not have recesses, projections or other surface structure. The surface multiplication factor r in the straight line L is 1 (r=1). On the other hand, a straight line M shown in FIG. 19 is obtained when the surface has recesses, projections or other surface structure. Introduction of a surface structure to the surface increases the surface area, thereby increasing the surface multiplication factor r in the straight line M to be larger than 1 (r>1).

A Cassie model is another surface structure model. As shown in FIG. 20, in the Cassie model, recesses 160 are formed in a solid 158. The recesses 160 are filled with a substance 159 different from the solid 158. When the surface portion is formed of two materials (the solid 158 and the substance 159) having different surface tensions, the apparent contact angle $\theta_f$ is determined by the relationship among the two materials (the solid 158 and the substance 159) at a surface 158*a*, a liquid 162, and true contact angles $\theta_1$ and $\theta_2$ (not shown). The relationship is represented by the following expression 6. In the following expression 6, $A_1$ and $A_2$ each represent a coefficient showing the area ratio of each substance in a composite surface. Those coefficients $A_1$ and $A_2$ have the relationship represented by the following expression 7.

$$\cos\theta_f = A_1\cdot\cos\theta_1 + A_2\cdot\cos\theta_2 \quad (6)$$

$$A_1 + A_2 = 1 \quad (7)$$

Suppose that one of the two kinds of materials is air, that is, fine recesses and projections are formed on the surface of one material (the solid 158) in the Cassie model. As shown in FIG. 21A, when the solid 158 itself exhibits repellency with respect to the target liquid 162 ($\theta_1$>90°), the liquid 162 cannot enter the recesses 160, so an air layer is present in the recesses 160.

The contact angle $\theta_2$ with respect to the air is 180°. Therefore, the apparent contact angle $\theta_f$ represented by the expression 6 can be newly represented by the following expression 8.

$$\cos\theta_f = (1 - A_2)\cos\theta_1 - A_2 (\theta_1 > 90°, \theta_2 = 180°) \quad (8)$$

On the other hand, when the single solid 158 exhibits lyophilic property with respect to the target liquid ($\theta_1$<90°), as shown in FIG. 21B, the liquid 162 enters the recesses 160, so the recesses 160 are filled with the liquid 162. At this time, the contact angle of the recesses 160 with respect to the liquid is 0°. Therefore, the apparent contact angle $\theta_f$ represented by the expression 6 can be newly represented by the following expression 9.

$$\cos\theta_f=(1-A_2)\cos\theta_1+A_2(\theta_1<90°,\ \theta_2=0°) \quad (9)$$

FIG. 22 is a graph showing the relationship between the contact angle $\theta_1$ and the apparent contact angle $\theta_f$ in the Cassie model in which the axis of ordinates indicates $\cos\theta_f$ and the axis of abscissas indicates $\cos\theta_1$.

In the Cassie model as well, as shown in FIG. 22, one which is lyophilic becomes more lyophilic, and one which is repellent becomes more repellent.

It should be noted that there is a description that the Wentzel model is applicable to a sharp change at a contact angle of around 90° in the Cassie model.

A Wentzel-Cassie integrated model obtained by integrating the Wentzel model and the Cassie model has also been proposed. The Wentzel-Cassie integrated model shows the properties of both the Wentzel model and the Cassie model.

As shown in FIG. 23, the relationship between the contact angle $\theta$ and the apparent contact angle $\theta_f$ in the Wentzel-Cassie integrated model is represented by a polygonal line K. In the Wentzel-Cassie integrated model, any value of the apparent contact angle of with respect to the contact angle $\theta$ as represented by the polygonal line K falls within a first A quadrant $D_{11}$ as an upper half of a first quadrant $D_1$ and a third A quadrant $D_{31}$ of a third quadrant $D_3$ with the line of $\cos\theta_f=\cos\theta$ as a boundary. The first A quadrant $D_{11}$ is a region in which lyophilic property increases and the contact angle reduces. The third A quadrant $D_{31}$ is a region in which repellency increases and the contact angle increases. In the Wentzel-Cassie integrated model, as shown in FIG. 23, any value of the apparent contact angle $\theta_f$ with respect to the contact angle $\theta$ remains within the first A quadrant $D_{11}$ and the third A quadrant $D_{31}$.

Thus, as shown in FIGS. 19, 22, and 23, in each of the Wentzel model, the Cassie model, and the Wentzel-Cassie integrated model, introduction of a surface structure to a solid does not lead to increase in repellency unless the solid itself exhibits repellency with respect to a target liquid, that is, unless the contact angle is more than 90°. Therefore, there is no repellent material capable of forming a contact angle of 90° or more with respect to a liquid having a low surface tension such as an organic solvent or oil. As a result, repellency with respect to an organic solvent or oil cannot be achieved.

A possible method for enhancing repellency is to increase the area ratio of the recesses as described above. It is thus considered that the water repellent films in JP 2005-23122 A and Non-Patent Document 1 can have enhanced repellency by increasing the area ratio of the recesses in the honeycomb structures. In JP 2005-23122 A and Non-Patent Document 1, droplets generated by condensation are evaporated to form pores, so the size of the droplets can be controlled to adjust the area ratio. However, control of the droplet size that requires a large number of experiments to determine the production conditions cannot be easily performed. In this way, it is difficult to control the area ratio of the recesses in JP 2005-23122 A and Non-Patent Document 1.

A first object of the present invention is to provide a liquid repellent structure having high repellency with respect to water, an organic solvent, oil and the like.

A second object of the present invention is to provide a liquid repellent structure-producing method that allows a large number of liquid repellent structures having high repellency with respect to water, an organic solvent, oil and the like to be produced at low cost.

A third object of the present invention is to provide a liquid ejection head capable of consistently ejecting liquids such as water, an organic solvent and oil.

A fourth object of the present invention is to provide a stain-resistant protective film.

In order to achieve the above-mentioned objects, according to a first aspect of the present invention, there is provided a liquid repellent structure comprising:

a support;

a honeycomb-patterned film formed by applying a solution of an organic compound in an organic solvent onto the support to form a solution film on the support, placing the support on which the solution film is formed in an atmosphere containing water vapor to form water droplets on a surface of the solution film and evaporating the organic solvent and the water droplets; and a coating film which is formed on a surface of the honeycomb-patterned film and is made of a fluorine-containing material.

According to a second aspect of the present invention, there is provided a liquid repellent structure comprising:

a support; and a liquid repellent film formed by applying a solution of an organic compound in an organic solvent onto the support to form a solution film on the support, placing the support in an atmosphere containing water vapor to form water droplets on a surface of the solution film, evaporating the organic solvent and the droplets, and further performing etching of the evaporated solution film.

The liquid repellent film is preferably of a structure selected from a porous structure, a fibrous structure, a framed structure and a needle-like structure.

The liquid repellent film is preferably formed of a fluorine-containing material.

The liquid repellent structure further comprises a coating film which is made of a fluorine-containing material and is formed on a surface of the liquid repellent film.

According to a third aspect of the present invention, there is provided a method of producing a liquid repellent structure comprising:

a step of applying a solution of an organic compound in an organic solvent onto a support;

a step of forming a honeycomb-patterned film, comprising: placing the support in an atmosphere containing water vapor to form water droplets on a surface of the solution film and evaporating the organic solvent and the droplets; and a step of forming a coating film made of a fluorine-containing material on a surface of the honeycomb-patterned film.

The step of forming the coating film preferably comprises a step of adsorbing the fluorine-containing material from a vapor phase.

The step of forming the coating film preferably comprises:

a step of immersing the support on which the honeycomb-patterned film has been formed in a film deposition solution containing an organic solvent for film deposition and the fluorine-containing material for a predetermined period of time;

a step of taking the immersed support out of the film deposition solution after the predetermined period of time;

a step of rinsing the immersed support with the organic solvent for film deposition; and a step of drying the rinsed support to form the coating film on the honeycomb-patterned film formed on the support.

The step of forming the coating film preferably uses a method selected from CVD, sputtering and vapor deposition.

According to a fourth aspect of the present invention, there is provided a method of producing a liquid repellent structure comprising:

a step of applying a solution of an organic compound in an organic solvent onto a support;

a step of forming a first honeycomb-patterned film, comprising: placing the support in an atmosphere containing water vapor to form water-droplets on a surface of the solution film and evaporating the organic solvent and the droplets; and a step of etching the first honeycomb-patterned film to form a second honeycomb-patterned film.

Preferably, this method further comprises:

a step of forming a coating film made of a fluorine-containing material on a surface of the second honeycomb-patterned film.

The step of forming the coating film preferably comprises:

a step of immersing the support on which the second honeycomb-patterned film has been formed in a film deposition solution containing an organic solvent for film deposition and the fluorine-containing material for a predetermined period of time;

a step of taking the immersed support out of the film deposition solution after the predetermined period of time;

a step of rinsing the immersed support with the organic solvent for film deposition; and a step of drying the rinsed support to form the coating film on the second honeycomb-patterned film formed on the support.

Preferably, this method further comprises:

a step of forming a reinforcing layer on a surface of the second honeycomb-patterned film; and a step of forming a coating film made of a fluorine-containing material on a surface of the reinforcing layer.

The step of forming the coating film preferably comprises:

a step of immersing the support on which the second honeycomb-patterned film and the reinforcing layer have been formed in a film deposition solution containing an organic solvent for film deposition and the fluorine-containing material for a predetermined period of time;

a step of taking the immersed support out of the film deposition solution after the predetermined period of time;

a step of rinsing the immersed support with the organic solvent for film deposition; and a step of drying the rinsed support to form the coating film on the reinforcing layer formed on the second honeycomb-patterned film formed on the support.

The organic compound is preferably a fluorine-containing material.

The step of etching preferably uses plasma etching or wet etching.

According to a fifth aspect of the present invention, there is provided a liquid ejection head for ejecting droplets of a solution, comprising:

an ejection substrate in which through-holes are formed, the droplets being ejected through the through-holes; and droplet ejection means for ejecting the droplets of the solution from the through-holes, each of the droplet ejection means being disposed for each through-hole, wherein the ejection substrate has a liquid repellent structure so that a solution-ejection surface of the ejection substrate around the through-holes corresponds to an upper surface of the liquid repellent structure, the liquid repellent structure comprising:

a support;

a honeycomb-patterned film formed by applying a solution of an organic compound in an organic solvent onto the support to form a solution film on the support, placing the support on which the solution film is formed in an atmosphere containing water vapor to form water droplets on a surface of the solution film and evaporating the organic solvent and the water droplets; and a coating film which is formed on a surface of the honeycomb-patterned film and is made of a fluorine-containing material.

It is preferable that the solution include charged particles dispersed therein, that the droplet ejection means comprise: ejection electrodes which are disposed for the individual through-holes and causes an electrostatic force to act on the solution; and solution guides which extend through the ejection substrate and protrude on a droplet-ejecting side of the ejection substrate, and that the electrostatic force from the ejection electrodes cause the droplets to be ejected.

The droplet ejection means preferably comprises piezoelectric or thermal droplet ejection means that ejects the droplets from the respective through-holes of the ejection substrate.

According to a sixth aspect of the present invention, there is provided a liquid ejection head for ejecting droplets of a solution, comprising:

an ejection substrate in which through-holes are formed, the droplets being ejected through the through-holes; and ejecting units for ejecting the droplets of the solution from the through-holes, each ejecting unit being disposed for each through-hole, wherein the ejection substrate has a liquid repellent structure so that a solution-ejection surface of the ejection substrate around the through-holes corresponds to an upper surface of the liquid repellent structure, the liquid repellent structure comprising:

a support; and a liquid repellent film formed by applying a solution of an organic compound in an organic solvent onto the support to form a solution film on the support, placing the support in an atmosphere containing water vapor to form water droplets on a surface of the solution film, evaporating the organic solvent and the droplets, and further performing etching of the evaporated solution film.

According to a seventh aspect of the present invention, there is provided a protective film comprising:

a support base; and a liquid repellent structure formed on a surface of the support base, the liquid repellent structure comprising:

a support;

a honeycomb-patterned film formed by applying a solution of an organic compound in an organic solvent onto the support to form a solution film on the support, placing the support on which the solution film is formed in an atmosphere containing water vapor to form water droplets on a surface of the solution film and evaporating the organic solvent and the water droplets; and a coating film which is formed on a surface of the honeycomb-patterned film and is made of a fluorine-containing material.

According to an eighth aspect of the present invention, there is provided a protective film comprising:

a support base; and a liquid repellent structure formed on a surface of the support base, the liquid repellent structure comprising:

a support; and a liquid repellent film formed by applying a solution of an organic compound in an organic solvent onto the support to form a solution film on the support, placing the support in an atmosphere containing water vapor to form water droplets on a surface of the solution film, evaporating the organic solvent and the droplets, and further performing etching of the evaporated solution film.

The liquid repellent structure in the first aspect of the present invention that has a support; a honeycomb-patterned film formed by applying a solution of an organic compound in an organic solvent onto the support to form droplets on a surface of the organic solvent-containing solution and evaporating the organic solvent and the droplets; and a coating which is formed on a surface of the honeycomb-patterned film and is made of a fluorine-containing material, enables the contact angle to be increased with respect to water, an organic solvent, oil and the like, thus achieving high repellency. The contact angle can also be increased with respect to a liquid having a surface tension lower than that of water such as a liquid having a surface tension of 40 mN/m or less, thus achieving high repellency.

The liquid repellent structure in the second aspect of the present invention that has a support; and a liquid repellent film formed by applying a solution of an organic compound in an organic solvent onto the support to form droplets on a surface of the organic solvent-containing solution, evaporating the organic solvent and the droplets and further performing etching, enables the contact angle to be increased with respect to water, an organic solvent, oil and the like, thus achieving high repellency. The contact angle can also be increased with respect to a liquid having a surface tension lower than that of water such as a liquid having a surface tension of 40 mN/m or less, thus achieving high repellency.

The method of producing the liquid repellent structure in the third aspect of the present invention that includes a step of applying a solution of an organic compound in an organic solvent onto a support; a step of forming a honeycomb-patterned film which involves placing the support in an atmosphere containing water vapor to form droplets on a surface of the organic solvent-containing solution and evaporating the organic solvent and the droplets; and a step of forming a coating made of a fluorine-containing material on a surface of the honeycomb-patterned film, enables the contact angle to be increased with respect to water, an organic solvent, oil and the like, thus achieving high repellency. The contact angle can also be increased with respect to a liquid having a surface tension lower than that of water such as a liquid having a surface tension of 40 mN/m or less, thus achieving high repellency.

The method of producing the liquid repellent structure in the third aspect of the present invention does not employ photolithography, so patterning is not necessary in the production process, resulting in a reduced number of steps and a simplified production process. Therefore, the liquid repellent structure can be produced at low cost. This production method only involves applying the organic solvent-containing solution onto the support, forming the droplets by condensation and thereafter evaporating the formed droplets, so patterning is not necessary, resulting in a reduced number of steps and a simplified production process and, for example, a sheet-like structure having a large area can also be easily produced.

The method of producing the liquid repellent structure in the fourth aspect of the present invention that includes a step of applying a solution of an organic compound in an organic solvent onto a support; a step of forming a honeycomb-patterned film which involves placing the support in an atmosphere containing water vapor to form droplets on a surface of the organic solvent-containing solution and evaporating the organic solvent and the droplets; and a step of etching the honeycomb-patterned film to form a second honeycomb-patterned film, enables the contact angle to be increased with respect to water, an organic solvent, oil and the like, thus achieving high repellency. The contact angle can also be increased with respect to a liquid having a surface tension lower than that of water such as a liquid having a surface tension of 40 mN/m or less, thus achieving high repellency.

The method of producing the liquid repellent structure in the fourth aspect of the present invention does not employ photolithography, so patterning is not necessary in the production process, resulting in a reduced number of steps and a simplified production process. Therefore, the liquid repellent structure can be produced at low cost. This production method only involves applying the organic solvent-containing solution onto the support, forming the droplets by condensation, evaporating the formed droplets and further performing etching, so patterning is not necessary, resulting in a reduced number of steps and a simplified production process and, for example, a sheet-like structure having a large area can also be easily produced.

The liquid ejection heads in the fifth and sixth aspects of the present invention in which the liquid repellent structure in the first or second aspect of the present invention is provided in such a manner that the surface of the liquid repellent structure can be a solution ejection surface of an ejection substrate around through-holes enable the contact angle to be increased with respect to water, an organic solvent, oil and the like. The contact angle can also be increased with respect to a liquid having a surface tension lower than that of water such as a liquid having a surface tension of 40 mN/m or less, thus stabilizing meniscus. Water, an organic solvent, oil and the like can be thus consistently ejected to obtain a high-quality image. Even in the case where a liquid having a surface tension of 40 mN/m or less is used for ink, the ink can be consistently ejected to obtain a high-quality image.

The protective films in the seventh and eighth aspects of the present invention each including a support base and the liquid repellent structure in the first or second aspect of the present invention formed on a surface of the support base, enable the contact angle to be increased with respect to water, an organic solvent, oil and the like, thus achieving high repellency. The contact angle can also be increased with respect to a liquid having a surface tension lower than that of water such as a liquid having a surface tension of 40 mN/m or less, thus repelling oil that is a main component of stains to facilitate oil removal. Stains can be thus prevented from being caused by adhesion of fingerprints, sebum, sweat, cosmetics and the like and even if they cause stains, the stains can be easily removed. Since the protective films in the seventh and eighth aspects of the present invention can prevent stains from being caused by fingerprints, sebum, sweat, cosmetics and the like, the protective film can be advantageously used for, for example, a touch panel or a filter to be attached to the surface of any one of various monitors.

DETAILED DESCRIPTION OF THE PREFERRED EMBODIMENTS

The repellency increasing structure and the method of producing the same, the liquid ejection head and the protective film according to the present invention will be described below in detail with reference to preferred embodiments shown in the accompanying drawings.

The repellency increasing structure will be first described.

Figure 1:
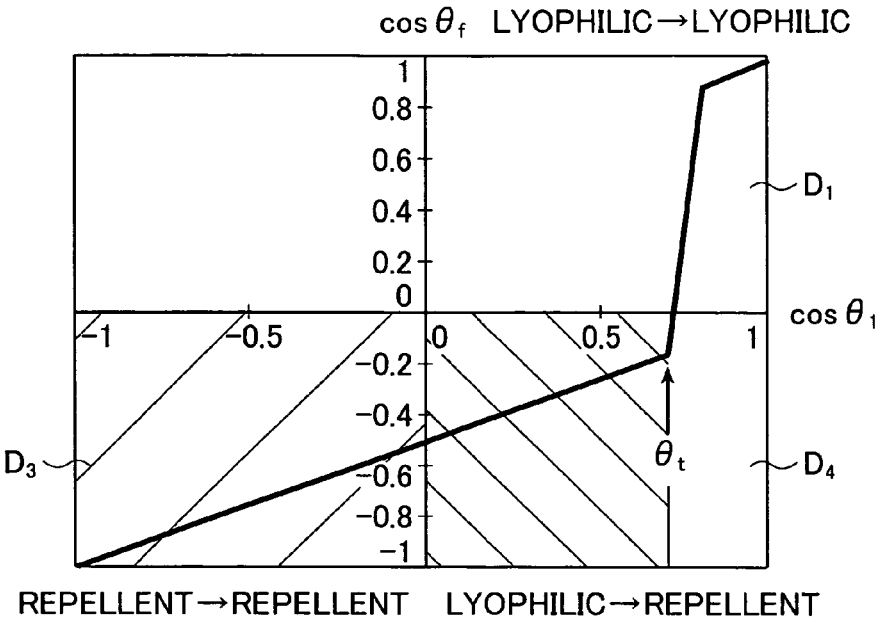
FIG. 1 is a graph showing a relationship between the contact angle $\theta_1$ and the apparent contact angle $\theta_f$ in a surface structure model of the present invention in which the axis of ordinates indicates $\cos\theta_f$ and the axis of abscissas indicates $\cos\theta_1$.

FIG. 1 is a graph showing a relationship between the contact angle $\theta_1$ and the apparent contact angle of in a surface structure model of the present invention in which the axis of ordinates indicates cos $\theta_f$ and the axis of abscissas indicates cos $\theta_1$.

The inventors of the present invention have made extensive studies about a surface structure and a repellent material. As a result, they have found that improvement from lyophilic property to repellency is possible through the effect of air inclusion in recesses based on the modification of the Cassie model owing to the optimized surface structure and repellent material. That is, they have found that even in a solid having a contact angle of 90° or less (a lyophilic material), the contact angle can be increased to 90° or more, or increased to some extent although the contact angle is not more than 90° depending on the surface structure. Thus, they have found means for increasing the contact angle with respect to even a liquid having a low surface tension such as an organic solvent or oil, thereby achieving the present invention.

Figure 19:
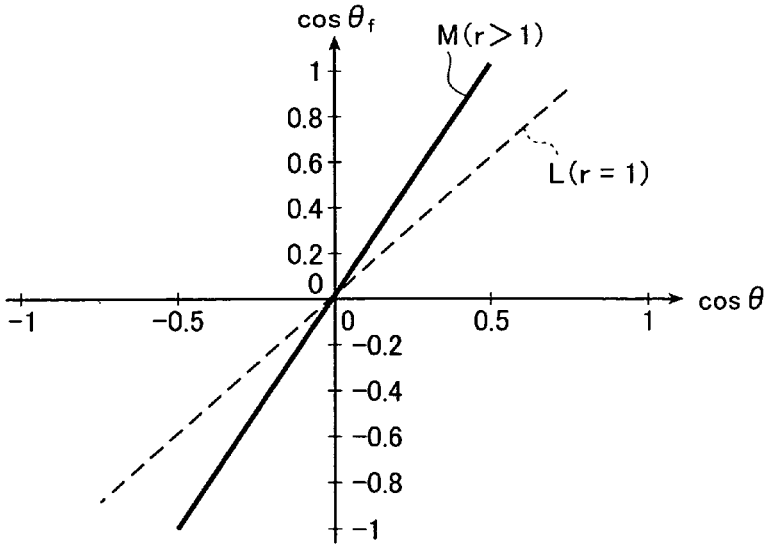
FIG.19 PRIOR ART
FIG. 19 is a graph showing a relationship between the contact angle $\theta$ and the apparent contact angle $\theta_f$ in the Wentzel model in which the axis of ordinates indicates cos $\theta_f$ and the axis of abscissas indicates cos $\theta$.
Figure 20:
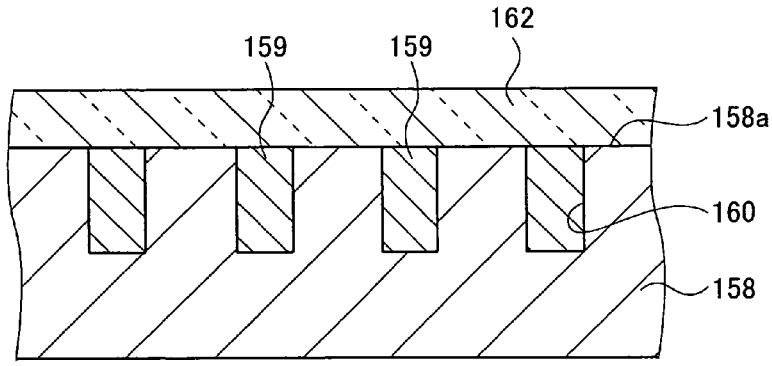
FIG.20 PRIOR ART
FIG. 20 is a schematic view showing a Cassie model.
Figure 22:
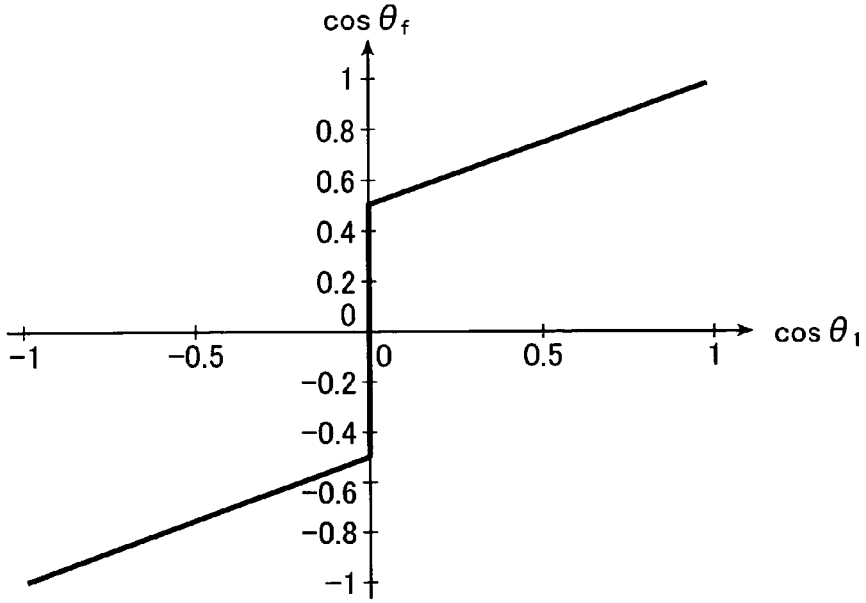
FIG. 22 PRIOR ART
FIG. 22 is a graph showing a relationship between the contact angle $\theta_1$ and the apparent contact angle $\theta_f$ in the Cassie model in which the axis of ordinates indicates cos $\theta_f$ and the axis of abscissas indicates cos $\theta_1$.
Figure 23:
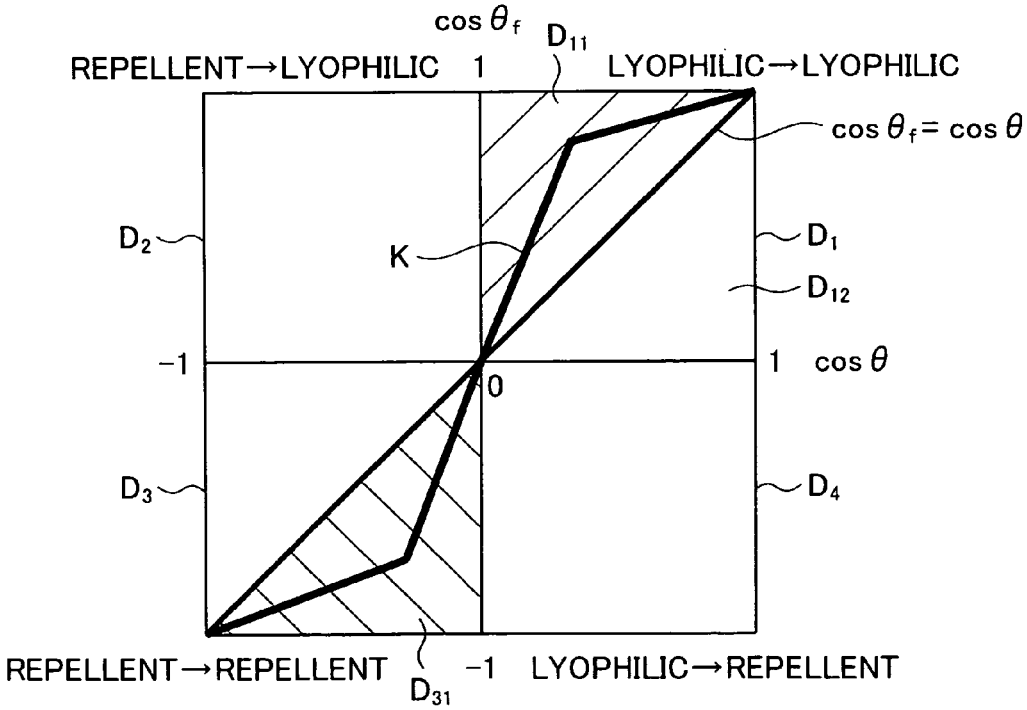
FIG. 23 PRIOR ART
FIG. 23 is a graph showing a relationship between the contact angle $\theta$ and the apparent contact angle $\theta_f$ in a Wentzel-Cassie integrated model in which the axis of ordinates indicates cos $\theta_f$ and the axis of abscissas indicates cos $\theta_1$.

In a generally well known model (such as a Wentzel model or a Cassie model), it is impossible to improve repellency unless a solid material itself has repellency (see FIG. 19, FIG. 22, and FIG. 23). According to such models, it can be easily expected that a large contact angle is obtained with respect to a liquid having a high surface tension such as water, but the solid material has a small contact angle with respect to a liquid having a low surface tension such as an organic solvent or oil and hence has no repellency. In many reports, high repellency has been reported based on the experimental results obtained with water, but no experiment has been conducted using an organic solvent, oil, or the like. In addition, many inventions show examples (experimental results) on the repellency with respect to water and no additional experiments have been conducted. Furthermore, a description indicating repellency with respect to an organic solvent, oil, or the like can also be found, although lack of repellency can be expected from a conventional model. It cannot be said that those inventions were derived from correct findings.

In view of the foregoing, the inventors of the present invention have made detailed studies about the shape of an uneven surface structure. As a result, they have found that a Cassie model may be modified. That is, even if a contact angle of 90° or less is formed owing to the nature of a material, the contact angle can be increased through introduction of a surface structure. When a contact angle of 90° or less is formed owing to the nature of a material in a conventional model, the contact angle is reduced through introduction of a surface structure. That is, a lyophilic material is made more lyophilic.

Figure 21A:
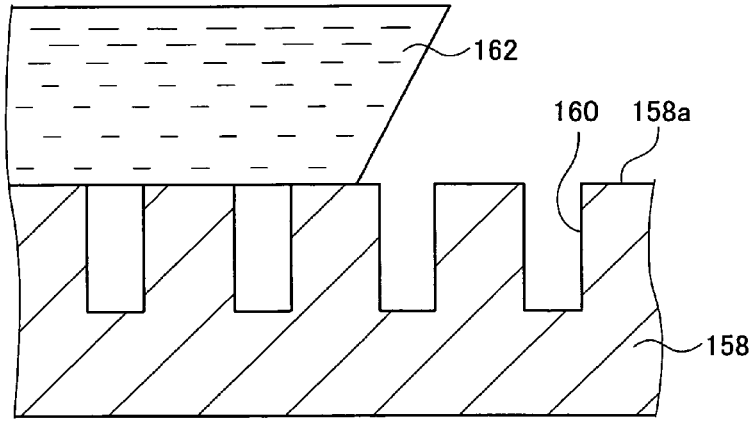
FIG.21A PRIOR ART
FIG. 21A is a schematic sectional view showing a state where a solid has repellency in the Cassie model.
Figure 21B:
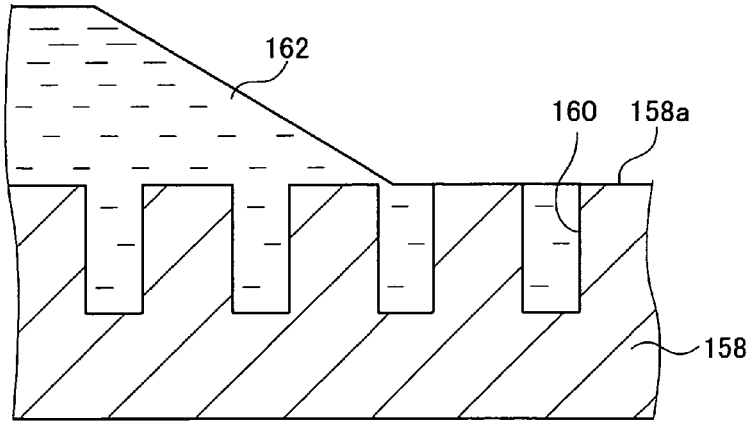
FIG.21B PRIOR ART
FIG. 21B is a schematic sectional view showing a state where the solid has lyophilic property in the Cassie model.

Even when the contact angle 91 determined by the nature of a material is 90° or less ($\cos\theta_1>0$), the state where the recesses 160 are filled with air is maintained (see FIG. 21A and the expression 8), and, as shown in FIG. 1, the contact angle $\theta_f$ increases. In this case, the contact angle of is represented by the following expression 10.

$$\cos\theta_f=(1-A_2)\cos\theta_1-A_2(\theta_1<90°,\ \theta_t>90°,\ \theta_2=180°) \quad (10)$$

Then, when a certain value ($\theta_1=\theta_t$ (transition angle)) is exceeded, lyophilic property is exhibited in accordance with the Cassie model (see FIG. 22 and the expression 9). The transition angle $\theta_t$ in the Cassie model is 90° but it has been found that the transition angle $\theta_t$ is shifted to 90° or less by forming an uneven surface structure on the surface of a solid.

In the present invention, a solid that is lyophilic with respect to a predetermined liquid at an angle smaller than the transition angle $\theta_t$ is allowed to be repellent with respect to the predetermined liquid. The transition angle is related to, for example, the sharpness of the recesses or projections and the angle formed by the recesses or projections.

In general, lyophilic property and repellency are distinguished from each other at a contact angle of 90° as a reference. However, there are no grounds for the distinction thermodynamically. In each of the Wentzel model and the Cassie model, lyophilic property and repellency are separately treated, and the boundary between the two properties is not taken into consideration at all. In the Wentzel model, when a contact angle of 90° or less is formed owing to the nature of a material, the contact angle remains unchanged (is 90°) even if a surface structure is introduced. In the Cassie model, a sharp change is supposed to occur at a contact angle of around 90°. In an actual surface, behaviors represented by both the models should be simultaneously present, so detailed examination at a contact angle of around 90° is needed. As a result of the detailed examination, it has been found that, in a surface structure according to the Cassie model, the transition angle at which a sharp change occurs varies depending on the surface structure and even a lyophilic material may be rendered repellent owing to the surface structure.

In FIG. 1, the first quadrant $D_1$ is a region in which a solid which is repellent with respect to a predetermined liquid becomes repellent. The third quadrant $D_3$ is a region in which a solid which is lyophilic with respect to a predetermined liquid becomes lyophilic. The fourth quadrant $D_4$ is a region in which a solid which is lyophilic with respect to a predetermined liquid becomes repellent.

The inventors of the present invention have made extensive studies about a surface structure and a repellent material. As a result, they have found that repellency is increased by the effect based on the modification of the Wentzel model or the Cassie model owing to the optimized surface structure and repellent material, which enables improvement from lyophilic property to repellency. That is, they have found that even in a solid whose contact angle is 90° or less (a lyophilic material), the contact angle is increased to 90° or more, or is increased to some extent although the contact angle is not more than 90° by introducing a surface structure to the solid. Thus, they have found means for imparting repellency to the solid so that the solid is repellent with respect to a liquid having a low surface tension such as an organic material or oil.

As shown in FIG. 23, in the Wentzel-Cassie integrated model, any value of the apparent contact angle $\theta_f$ with respect to the contact angle $\theta$ falls within the first A quadrant $D_{11}$ of the first quadrant $D_1$ and the third A quadrant $D_{31}$ of the third quadrant $D_3$ with the line of $\cos\theta_f=\cos\theta$ as a boundary, and moves only in the first A quadrant $D_{11}$ and the third A quadrant $D_{31}$. The first A quadrant $D_{11}$ is a region in which lyophilic property increases and the contact angle reduces. The third A quadrant $D_{31}$ is a region in which repellency increases and the contact angle increases. In the Wentzel-Cassie integrated model, it can also be easily expected that, even when a large contact angle is obtained with respect to a liquid having a high surface tension such as water, the contact angle with respect to a liquid having a low surface tension such as an organic solvent or oil is small and hence no repellency is exhibited.

The other regions in FIG. 23 are seen next. A first B quadrant $D_{12}$ is a region in which lyophilic property is reduced (that is, repellency is increased) by introducing a surface structure to a solid material having lyophilic property. In the first B quadrant $D_{12}$, the contact angle is increased by introducing a surface structure; provided, however, that the contact angle is 90° or less.

The fourth quadrant $D_4$ is a region in which a solid material having lyophilic property is rendered repellent by introducing a surface structure to the solid material. This means that the introduction of a surface structure increases the contact angle of the solid material of 90° or less to be 90° or more.

Figure 2:
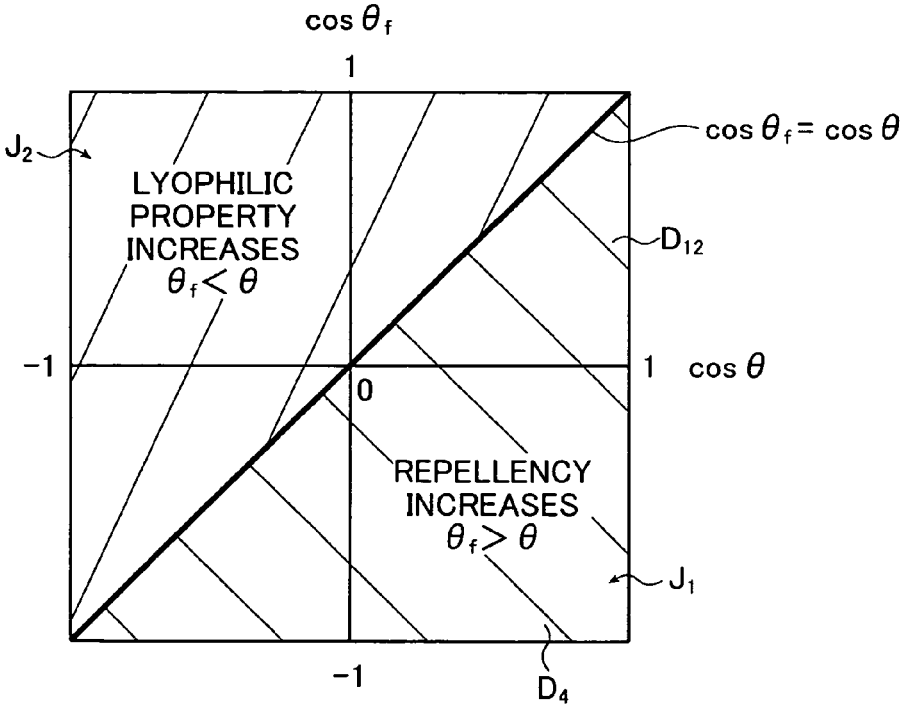
FIG. 2 is a graph showing a repellency increasing region and a lyophilic property increasing region in which the axis of ordinates indicates cos $\theta_f$ and the axis of abscissas indicates cos $\theta$.

Therefore, each of the third A quadrant $D_{31}$, the first B quadrant $D_{12}$, and the fourth quadrant $D_4$ can be said to be a region in which repellency increases. As shown in FIG. 2, a region $J_1$ in a lower half and a region $J_2$ in an upper half with respect to the line of $\cos\theta_f=\cos\theta$ as a boundary can be defined as a repellency increasing region and a lyophilic property increasing region, respectively.

In view of the foregoing, the inventors of the present invention have made detailed studies about the shape of an uneven surface structure. As a result, they have found that the conventional Wentzel-Cassie integrated model may be modified. That is, even when a contact angle of 90° or less is formed owing to the nature of a material, the contact angle can be increased by introducing a surface structure. This means that a value of the apparent contact angle $\theta_f$ with respect to the contact angle $\theta$ may fall within the first B quadrant $D_{12}$ and the fourth quadrant $D_4$ in FIG. 2 depending on the surface structure.

Figure 3:
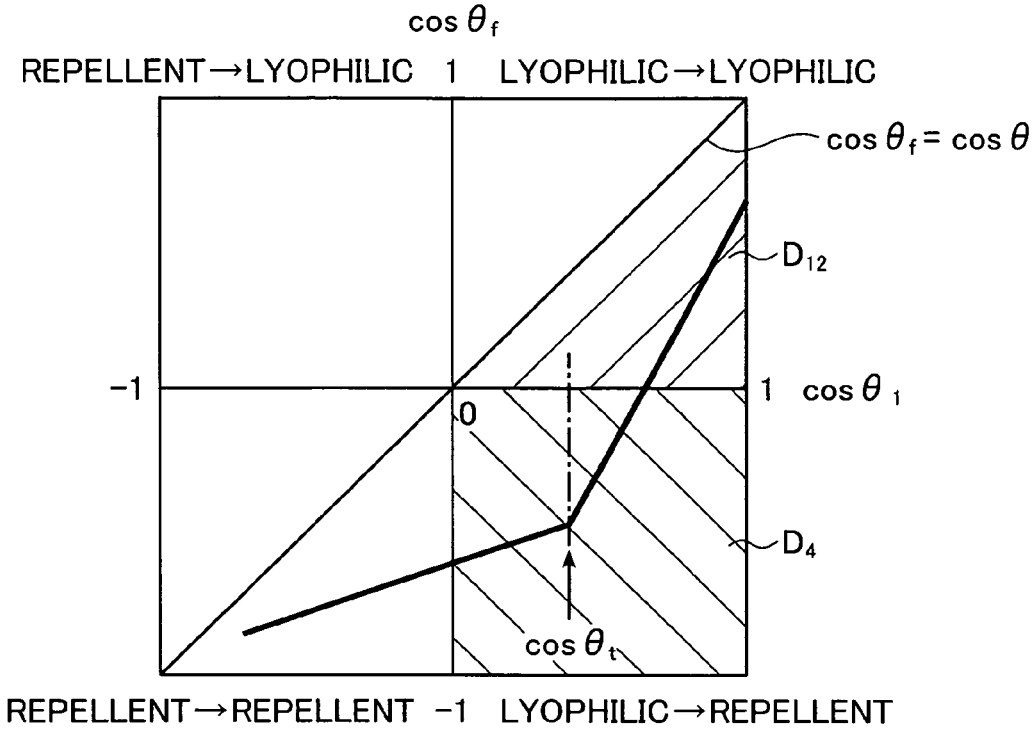
FIG. 3 is a graph showing a further detailed relationship between the contact angle $\theta_1$ and the apparent contact angle $\theta_f$ in the surface structure model of the present invention in which the axis of ordinates indicates cos $\theta_f$ and the axis of abscissas indicates cos $\theta_1$.

FIG. 3 is a graph showing results obtained by making the detailed studies.

Even when the contact angle $\theta_1$ determined by the nature of a material is 90° or less ($\cos\theta_1>0$), the state where the recesses 160 are filled with air is maintained (see FIG. 21A and the expression 8), and the contact angle $\theta$ increases.

In this case, the contact angle $\theta_f$ is represented by the following expressions 11 and 13. The expression 11 holds true even when there is no restriction ($\theta_1$>90°) on the repellency in the Cassie model (the expression 8) and the contact angle $\theta_1$ is 90° or less. The expression 11 holds true when the contact angle $\theta_1$ is larger than the transition angle $\theta_t$ obtained from the expression 12.

$$\cos\theta_f = (1-A)\cos\theta_1 - A \ (\theta_t < 90°, \theta_1 > \theta_t) \tag{11}$$

$$\theta_t = \cos^{-1}\left(\frac{b-A}{r+A-1}\right) \tag{12}$$

In addition, a modified Wentzel model (the following expression 13) holds true when the contact angle $\theta_1$ is smaller than $\theta_t$. In the expression 13, an additional factor b is added. The additional factor b is a coefficient that mainly depends on A.

According to the expression 13, any value of the apparent contact angle $\theta_f$ with respect to the contact angle $\theta_1$ remains within the fourth quadrant $D_4$ and the first B quadrant $D_{12}$ that are repellency increasing regions even at an angle equal to or larger than the transition angle $\theta_t$. This phenomenon can be observed as if the transition angle at which the transition from a Cassie model to a Wentzel model occurs in a conventional Wentzel-Cassie integrated model shifted toward the right direction (toward $\cos\theta_1=1$).

$$\cos\theta_f = r\cdot\cos\theta_1 - b(\theta_t<90°, \theta_1<\theta_t) \tag{13}$$

In the present invention, even if a solid is lyophilic with respect to a predetermined liquid, the solid is allowed to be repellent with respect to the predetermined liquid or the contact angle is allowed to increase although the solid remains lyophilic. Such tendency is related to the angle of an recess or projection and the pattern shape.

As described above, in each of the Wentzel model and the Cassie model, lyophilic property and repellency are separately treated, and the boundary between the two properties is not taken into consideration at all. In the actual solid surface, behaviors represented by both the Wentzel model and the Cassie model should be simultaneously present, so detailed examination at a contact angle of around 90° is needed. As a result of the detailed examination made by the inventors of the present invention, it has been found that, in an uneven surface structure which has however substantially flat, properties as shown in FIG. 3 are obtained depending on the pattern and angle of a recess or a projection by the estimation from a conventional model and that the introduction of a surface structure allows even a lyophilic solid to exhibit repellency.

Next, the liquid repellent structure and its production method, the liquid ejection head and the protective film according to the present invention will be described below.

Figure 4:
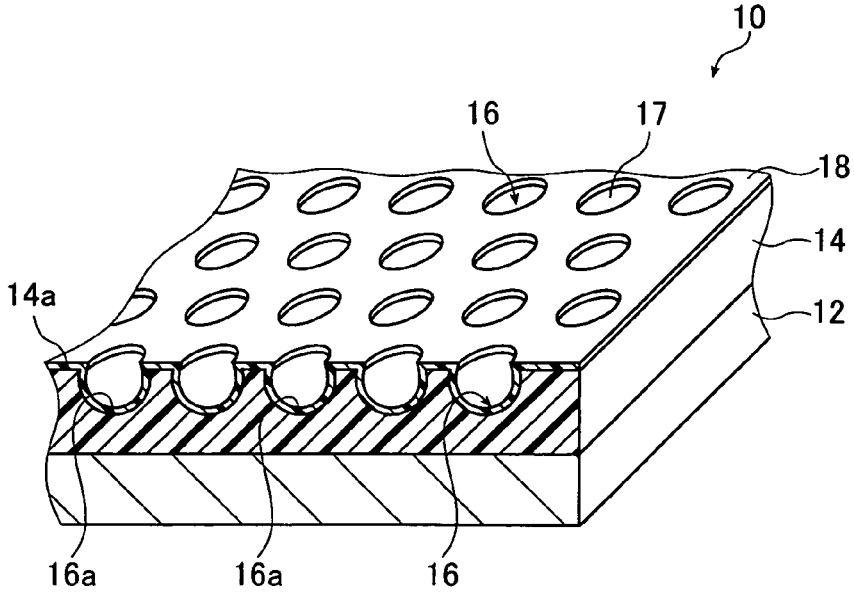
FIG. 4 is a schematic perspective view showing a liquid repellent structure according to a first embodiment of the present invention.

FIG. 4 is a schematic perspective view showing a liquid repellent structure according to a first embodiment of the present invention.

As shown in FIG. 4, a liquid repellent structure 10 of this embodiment includes a support 12, a honeycomb-patterned film 14 formed on the support 12, and a coating 18 formed on the surface of the honeycomb-patterned film 14.

The support 12 is a flat sheet.

In this embodiment, there is no particular limitation on the composition of the support 12 but a metal, an alloy, a resin or glass may be used according to the material of the honeycomb-patterned film 14, the production method, the condition of its use and the like.

Specific examples of the material that may be used for the support 12 include cellulose ethers such as triacetyl cellulose, diacetyl cellulose and propionyl cellulose. Polyolefins such as polypropylene, polyethylene and polymethylpentene may also be used for the support 12. Polyethylene terephthalate (PET), polyethylene naphthalate (PEN), polyimide (PI), cycloolefin resin and the like can be further used for the support 12.

The honeycomb-patterned film 14 has recesses 16 formed at a surface 14*a* thereof. The recesses 16 serve to impart repellency to the honeycomb-patterned film 14. As described above, formation of the recesses 16 allows the apparent contact angle of to be increased. In this way, the honeycomb-patterned film 14 has repellency based on its own structural properties.

The area ratio of the recesses 16 in the honeycomb-patterned film 14 is preferably at least 18%, more preferably at least 40% and even more preferably at least 60%. The higher the area ratio of the recesses 16 is, the larger the apparent contact angle $\theta_f$ is.

In this embodiment, the honeycomb-patterned film 14 is made of a fluorine-free or non-fluorine-based polymeric compound.

Examples of the non-fluorine-based polymeric compound that may be desirably used include poly(ε-caprolactone), poly(3-hydroxybutyrate), agarose, ARTON (JSR Corporation), poly(2-hydroxyethyl acrylate), polysulfone, polystyrene, polylactic acid, and polybutadiene.

In the honeycomb-patterned film 14, each of the recesses 16 preferably has an opening 17 whose size is sufficiently small to allow the opening 17 to disregard a target droplet.

The opening 17 of each recess 16 preferably has a size of not more than 10 μm and more preferably not more than 1 μm.

The entire surface of the honeycomb-patterned film 14 including inner surfaces 16*a* of the recesses 16 are coated with the coating 18. The coating 18 inherently has repellency and is made of, for example, a low molecular weight, repellent material having ten or more fluorine (F) atoms such as fluoroalkylsilane.

In this embodiment, the coating 18 has a sufficient thickness to allow the shape of the recesses 16 to be maintained, for example a thickness of 100 nm. The coating 18 has preferably a thickness of not more than 10 nm. At a thickness falling within the above range, the recesses 16 are not filled with the repellent material but the localized uneven surface structure of the honeycomb-patterned film 14 is maintained. Therefore, two effects can be achieved, that is, repellency owing to the surface structure having locally formed irregularities and, repellency owing to the coating 18 can be exhibited.

As described above, the two effects can be achieved by forming the coating 18 on the entire surface 14*a* of the honeycomb-patterned structure 14 including the inner surfaces 16*a* of the recesses 16 in the liquid repellent structure 10 of this embodiment. In other words, repellency owing to the surface structure obtained by locally forming irregularities in the honeycomb-patterned film 14 and, liquid repellency owing to the coating 18 can be exhibited. Therefore, repellency with respect to a liquid having a surface tension lower than that of water such as an organic solvent, oil, or a liquid having a surface tension of 40 mN/m or less can be increased to thereby achieve high repellency.

Next, a method of producing the liquid repellent structure 10 of this embodiment will be described.

FIGS. 5A to 5E are schematic sectional views illustrating the method of producing the liquid repellent structure according to the first embodiment of the present invention in order of steps.

Figure 5A:
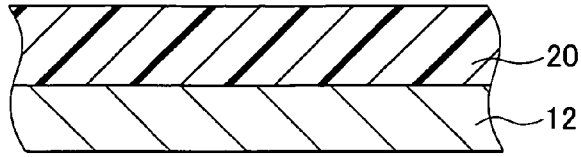
FIGS. 5A to 5E are schematic sectional views illustrating a method of producing the liquid repellent structure according to the first embodiment of the present invention in order of steps.

As shown in FIG. 5A, a solution (polymer solution) of a non-fluorine-based polymeric compound (organic compound) in an organic solvent is first applied to the surface of the support 12 to form a polymer solution film 20.

The polymeric material (non-fluorine-based polymeric compound) is a polymeric compound that dissolves in a water-insoluble solvent (i.e., a lipophilic solvent). Examples of the polymeric material that may be preferably used include poly(ε-caprolactone), poly(3-hydroxybutyrate), agarose, ARTON (JSR Corporation), poly(2-hydroxyethyl acrylate), polysulfone, polystyrene, polylactic acid, and polybutadiene. The organic solvent preferably has a lower boiling point than that of water. The cast polymeric material is placed in an atmosphere containing water vapor to condense water vapor on the surface of the material, and the organic solvent is evaporated so as to avoid water droplets formed on the surface by the condensation, whereby the honeycomb-patterned film is formed. Examples of the organic solvent that may be preferably used include chloroform, dichloromethane, carbon tetrachloride, cyclohexane, methyl acetate and polyacrylamide, and the organic solvent is desirably mixed in an amount of 30 wt % or less.

Exemplary methods that may be used for applying the polymer solution to the surface of the support 12 include slide coating, extrusion coating, bar coating and gravure coating.

Figure 5B:
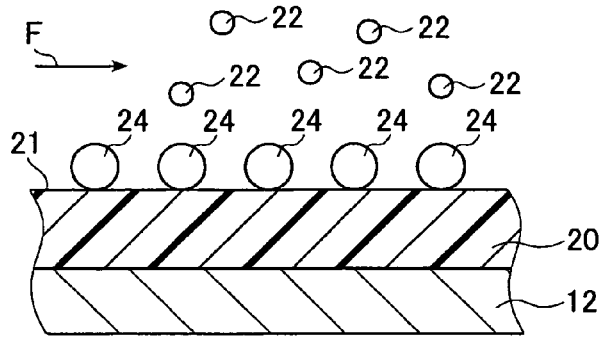

Next, as shown in FIG. 5B, air with a relative humidity of at least 50% adjusted for condensation is blown onto the polymer solution film 20 in a direction F parallel to its surface 21, whereby the polymer solution film 20 is placed in an atmosphere containing water vapor. When the polymer solution film 20 is placed in a humidified atmosphere (water vapor atmosphere), moisture 22 in the air condenses on the surface 21 of the polymer solution film 20 to form droplets 24 on the surface 21 of the polymer solution film 20. The droplets 24 further glows by the moisture 22 in the air (see FIG. 5C).

Figure 5C:
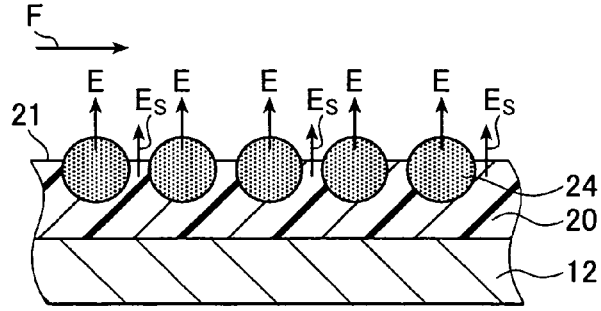

Next, as shown in FIG. 5C, the organic solvent in the polymer solution film 20 is dried under the condition that the droplets 24 are not evaporated. In general, the organic solvent volatilizes more rapidly than the water droplets, so drying of the polymer solution film 20 proceeds with the droplets 24 maintained. The droplets 24 are arranged in a substantially uniform manner owing to the capillary force from the volatilization.

Figure 5D:
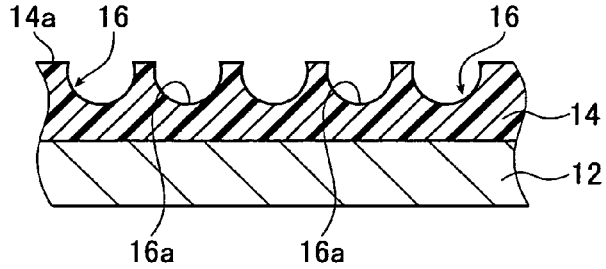

Next, by blowing dry air onto the polymer solution film 20 or placing the polymer solution film 20 in a dry atmosphere, the droplets 24 are evaporated as shown in FIG. 5D to leave the recesses 16 where the droplets 24 no longer exist, thus forming the honeycomb-patterned film 14.

Figure 5E:
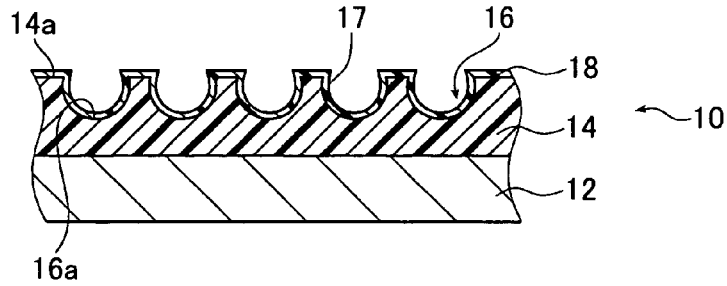

Next, as shown in FIG. 5E, the coating 18 is formed by, for example, spin coating on the surface 14*a* of the honeycomb-patterned film 14 and the inner surfaces 16*a* of the recesses 16, whereby the liquid repellent structure 10 is produced.

According to the method of producing the liquid repellent structure 10 of this embodiment, the droplets 24 are formed on the surface 21 of the polymer solution film 20 by condensation and dried to form the honeycomb-patterned film 14, which is entirely covered with the coating 18 to obtain the liquid repellent structure 10.

Spin coating is not the sole method of forming the coating 18. For example, the coating 18 may be formed by any one of a forming method that involves evaporating a fluorine-containing material by heating, CVD, sputtering, vacuum deposition and vapor adsorption. There is also a method in which the support 12 on which the honeycomb-patterned film 14 has been formed is immersed in a film deposition solution containing an organic solvent for film deposition and a fluorine-containing material for a predetermined period of time, after which the immersed support 12 is taken out of the film deposition solution, rinsed with the organic solvent for film deposition and dried to form the coating 18.

Equipment cost can be reduced in the method of producing the liquid repellent structure 10 of this embodiment that does not require the use of photolithography, an expensive production device or a cleaner environment than in photolithography.

According to the method of producing the liquid repellent structure 10 of this embodiment, the honeycomb-patterned film 14 is formed only by applying the organic solvent-containing solution to the surface of the support 12 to form the polymer solution film 20, forming the droplets 24 on the surface 21 of the film 20 by condensation and evaporating the formed droplets 24. Therefore, patterning is not necessary, resulting in a simplified production process and a reduced production time. The method of producing the liquid repellent structure 10 of this embodiment that uses the non-fluorine-based polymeric compound to form the honeycomb-patterned film 14 also offers a wide choice of materials and allows the restrictions on the conditions for producing the honeycomb-patterned film 14 to be eased. The liquid repellent structure 10 can be thus produced at low cost according to the method of producing the liquid repellent structure 10 of this embodiment.

In photolithography, the region where a pattern is formed in the patterning step is limited and in the case of patterning a large area, the patterning step is time-consuming and cumbersome. The method of producing the liquid repellent structure of this embodiment does not need the patterning but is capable of applying the organic solvent-containing solution to the support even if the support is a sheet with a large area. Therefore, the honeycomb-patterned film can be easily produced in a shorter period of time than in the case of employing photolithography. The coating can also be formed by, for example, spin coating even if the coating has a large area. Accordingly, the method of producing the liquid repellent structure 10 of this embodiment can easily provide the liquid repellent structure 10 with a large area.

Next, a liquid repellent structure according to a second embodiment of the present invention will be described. The same components as those in the liquid repellent structure 10 of the first embodiment shown in FIG. 4 are identified by the same reference numerals and their description will be omitted.

Figure 6:
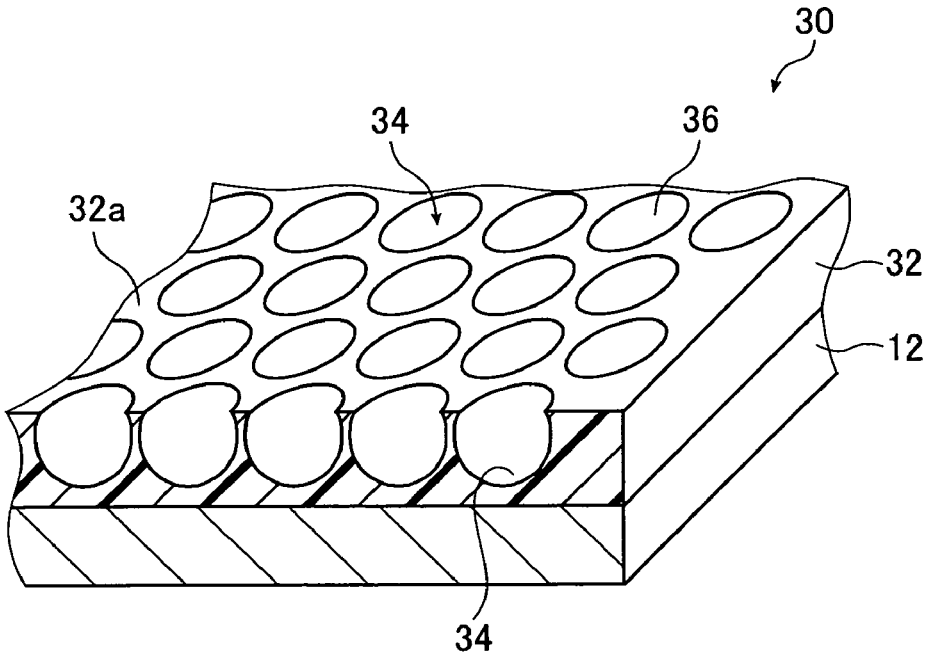
FIG. 6 is a schematic perspective view showing a liquid repellent structure according to a second embodiment of the present invention.

FIG. 6 is a schematic perspective view showing the liquid repellent structure according to the second embodiment of the present invention.

A liquid repellent structure 30 of the second embodiment has the same construction as that of the liquid repellent structure 10 of the first embodiment (see FIG. 4) except that the honeycomb-patterned film 14 is replaced by a liquid repellent film 32 and the liquid repellent structure 30 does not have the coating 18 (see FIG. 4), so its detailed description will be omitted.

The liquid repellent film 32 in the liquid repellent structure 30 of this embodiment has recesses 34 formed at a surface 32*a* of the film 32. The recesses 34 have the same structure as that of the recesses 16 in the first embodiment, but their openings 36 each have a larger diameter. The area ratio of the recesses 34 is also higher than that of the recesses 16 in the first embodiment. The recesses 34 are obtained by enlarging the recesses 16 through, for example, plasma etching on the honeycomb-patterned film 14 of the first embodiment.

As in the first embodiment, the liquid repellent film 32 is not limited to one having the recesses 34 formed therein. For example, the liquid repellent film 32 may not have the recesses 34 but be of a structure selected from a porous structure (see FIG. 7A), a fibrous structure (see FIG. 7B), a framed structure (see FIG. 7C) and a needle-like structure (see FIG. 7D).

Figure 7A:
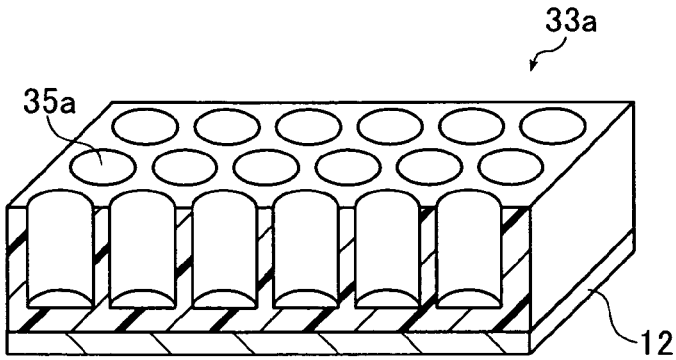
FIG. 7A is a schematic perspective view showing a liquid repellent film of a porous structure in the liquid repellent structure of the present invention.

The porous structure refers to a structure in which cylindrical recesses 35*a* whose openings each have a circular shape are formed as in a liquid repellent film 33*a* shown in FIG. 7A, for example.

Figure 7B:
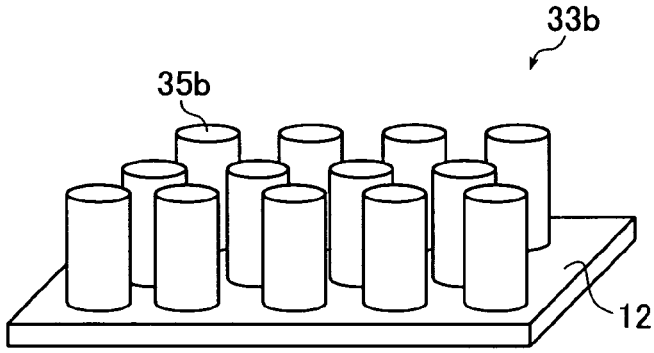
FIG. 7B is a schematic perspective view showing another liquid repellent film of a fibrous structure in the liquid repellent structure of the present invention.

The fibrous structure refers to a structure in which cylindrical projections 35*b* are formed on the support 12 as in a liquid repellent film 33*b* shown in FIG. 7B, for example.

Figure 7C:
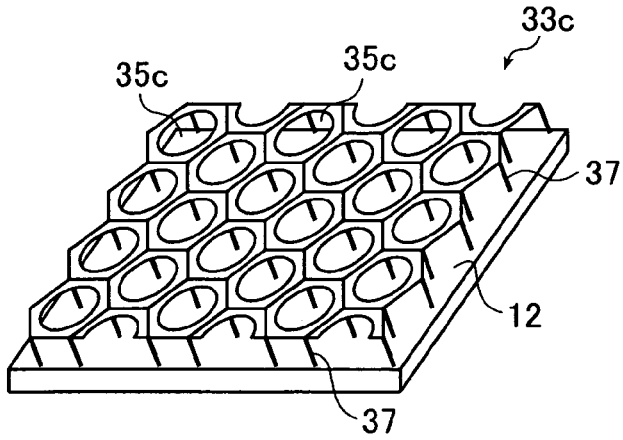
FIG. 7C is a schematic perspective view showing still another liquid repellent film of a framed structure in the liquid repellent structure of the present invention.

The framed structure refers to a structure in which cells which are hexagonal when viewed from above and which have circular openings formed therein are joined together on the same plane over the support 12 to form a net portion 35*c* and the net portion 35*c* is connected to the support 12 through pillars 37, as in a liquid repellent film 33*c* shown in FIG. 7C, for example.

Figure 7D:
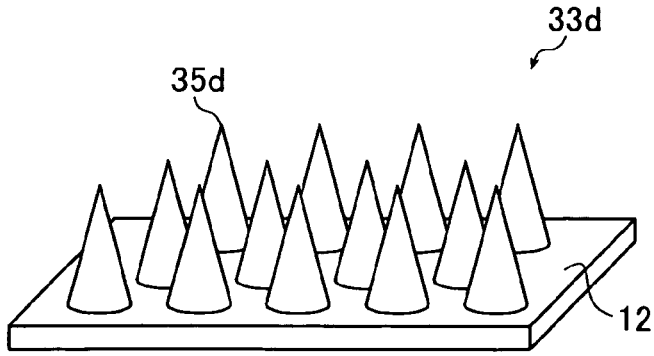
FIG. 7D is a schematic perspective view showing yet another liquid repellent film of a needle-like structure in the liquid repellent structure of the present invention.

The needle-like structure refers to a structure in which cones 35*d* are formed on the support 12 as in a liquid repellent film 33*d* shown in FIG. 7D, for example.

The structures such as the porous structure, the fibrous structure, the framed structure and the needle-like structure shown in FIG. 7A to FIG. 7D, respectively are obtained by subjecting the honeycomb-patterned film 14 of the first embodiment to plasma etching.

The liquid repellent film 32 inherently has repellency and is made of a fluorine-containing or fluorine-based polymeric compound.

Examples of the fluorine-based polymeric compound that may be used for the liquid repellent film 32 include a perfluoro group-containing fluoropolymer, a fluorine-containing polymeric material, a fluororesin, an amorphous fluoropolymer, polytetrafluoroethylene, and ethylene-tetrafluoroethylene.

The liquid repellent structure 30 of this embodiment in which the liquid repellent film 32 is made of a fluorine-based polymeric compound and the recesses 34 with larger opening diameters are formed offers repellency owing to the structure of the liquid repellent film 32 and that owing to the fluorine-based polymeric compound of which the film 32 is made. In this way, the contact angle with respect to a liquid having a surface tension lower than that of water such as an organic solvent, oil, or a liquid having a surface tension of 40 mN/m or less can be increased without forming the coating 18 having repellency on the surface of the liquid repellent film 32. Thus, high repellency and hence the same effects as in the first embodiment can be achieved.

Next, a method of producing the liquid repellent structure 30 of this embodiment will be described.

FIGS. 8A to 8E are schematic sectional views illustrating the method of producing the liquid repellent structure according to the second embodiment of the present invention in order of steps.

Figure 8A:
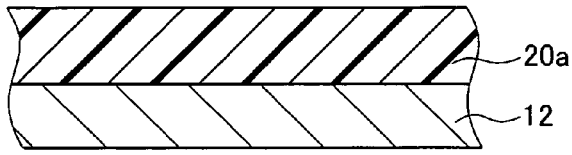
FIGS. 8A to 8E are schematic sectional views illustrating a method of producing the liquid repellent structure according to the second embodiment of the present invention in order of steps.
Figure 8B:
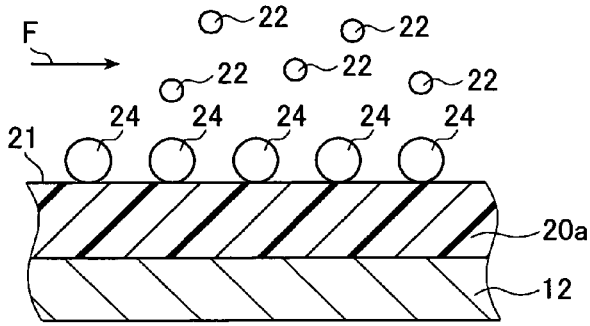
Figure 8C:
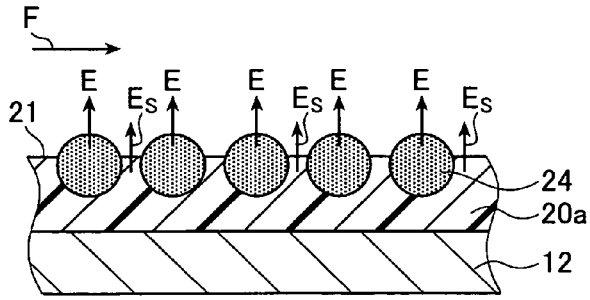

The steps shown in FIGS. 8A to 8C in this embodiment are the same as those in the method of producing the liquid repellent structure 10 of the first embodiment shown in FIGS. 5A to 5C except that a solution of a fluorine-based polymeric compound in an organic solvent is applied to the support 12 to form a polymer solution film 20*a*, so their detailed description will be omitted. Therefore, the step shown in FIG. 8D will be first described below in detail.

In this embodiment, the organic solvent in the organic solvent-containing solution used to form the polymer solution film 20*a* preferably has a boiling point of not more than 100° C. and more preferably not more than 60° C. The organic solvent-containing solution in this embodiment preferably contains not more than 10 wt % and more preferably not more than 1 wt % of a fluorine-based polymeric compound.

A layer of the polymer solution film 20*a* is formed on the surface of the support 12 in the state of the organic solvent-containing solution owing to its viscosity and hence is ready to volatilize.

Figure 8D:
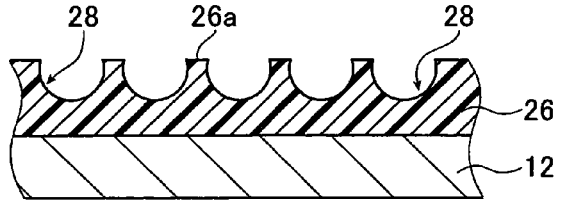

The same production method as that for the liquid repellent structure 10 of the first embodiment is repeated in this embodiment to evaporate droplets 24 formed on a surface 21 of the polymer solution film 20*a* to thereby form a honeycomb-patterned film 26 having recesses 28 formed at its surface 26*a*, as shown in FIG. 8D.

Figure 8E:
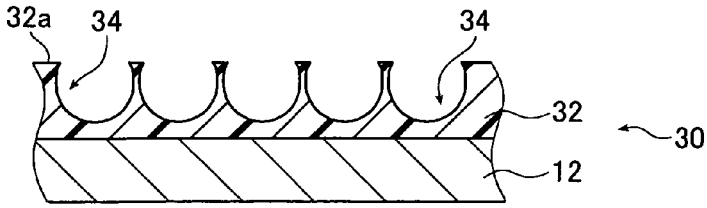

Then, the surface 26*a* of the honeycomb-patterned film 26 is subjected to, for example, oxygen plasma etching, which enlarges the recesses 28 of the honeycomb-patterned film 26 to form the liquid repellent film (second honeycomb-patterned film) 32 having the enlarged recesses 34 as shown in FIG. 8E. The liquid repellent structure 30 of this embodiment can be thus produced.

The method of producing the liquid repellent structure 30 of this embodiment has the same effects as those in the first embodiment. More specifically, the method of producing the liquid repellent structure 30 of this embodiment also does not employ photolithography, so patterning is not necessary, resulting in a reduced number of steps. Therefore, the liquid repellent structure 30 can be easily produced at low cost in a short period of time.

In this embodiment, plasma etching is performed to enlarge the diameter of each recess 34, so there is no need to enlarge the droplets 24 in order to form the honeycomb-patterned film 26. This eliminates the necessity of experiments for determining the production conditions and can increase the margin for the production conditions.

In this embodiment, for example, the liquid repellent film 32 may not have the recesses 34 but be of the porous structure, fibrous structure, framed structure or needle-like structure (see FIGS. 7A to 7D) by changing the plasma etching conditions in the case where the recesses 28 of the honeycomb-patterned film 26 are enlarged. The liquid repellent films 32 of different structures can be thus easily produced. The structures shown in FIGS. 7A to 7D ensure a higher area ratio and much higher repellency than the case where the liquid repellent film 32 has the recesses 34.

Plasma etching is not the sole method for obtaining the recesses 34 of the liquid repellent film 32 in this embodiment, but wet etching may be used to form the recesses. The liquid repellent films having the structures such as the porous structure, fibrous structure, framed structure and needle-like structure (see FIGS. 7A to 7D) may also be produced through wet etching.

Next, a liquid repellent structure according to a third embodiment of the present invention will be described. The same components as those in the liquid repellent structure 10 of the first embodiment shown in FIG. 4 are identified by the same reference numerals and their description will be omitted.

Figure 9:
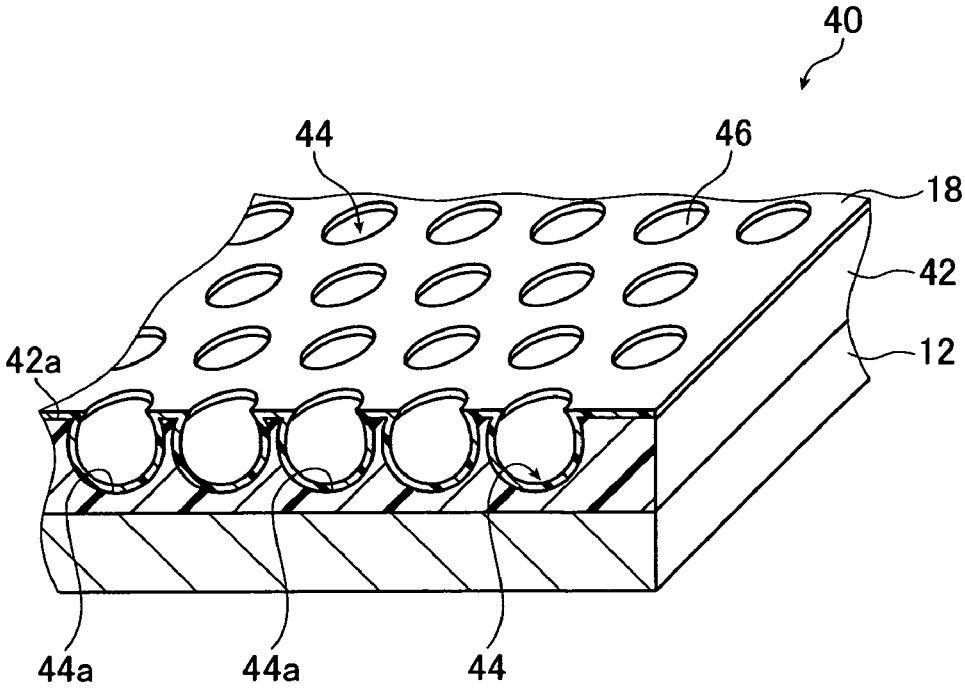
FIG. 9 is a schematic perspective view showing a liquid repellent structure according to a third embodiment of the present invention.

FIG. 9 is a schematic perspective view showing the liquid repellent structure according to the third embodiment of the present invention.

A liquid repellent structure 40 of this embodiment as shown in FIG. 9 has the same construction as that of the liquid repellent structure 10 of the first embodiment (see FIG. 4) except the structure of a honeycomb-patterned film 42, so its detailed description will be omitted.

The honeycomb-patterned film 42 of this embodiment has recesses 44 formed at its surface 42*a* as in the honeycomb-patterned film 14 of the first embodiment (see FIG. 4). The recesses 44 have the same structure as that of the recesses 16 in the first embodiment, but their openings 46 have larger diameters than in the first embodiment and the area ratio of the recesses 44 is also higher than in the first embodiment. The recesses 44 are obtained by enlarging the recesses 16 through, for example, plasma etching on the honeycomb-patterned film 14 of the first embodiment.

The honeycomb-patterned film 42 is not limited to one that has the recesses 44 formed therein. Instead of the one that has the recesses 44 formed therein, the honeycomb-patterned film 42 may be of, for example, the porous structure, fibrous structure, framed structure or needle-like structure (see FIGS. 7A to 7D). The porous structure, fibrous structure, framed structure and needle-like structure are obtained by subjecting the honeycomb-patterned film 14 of the first embodiment to, for example, plasma etching or wet etching.

The honeycomb-patterned film 42 of this embodiment is formed using a non-fluorine-based polymeric compound as in the honeycomb-patterned film 14 of the first embodiment.

The liquid repellent structure 40 of this embodiment can also achieve the same effects as those in the first embodiment. In addition, since the area ratio of the recesses 44 in the honeycomb-patterned film 42 is higher than that in the first embodiment, the contact angle with respect to a liquid having a surface tension lower than that of water such as an organic solvent, oil, or a liquid having a surface tension of 40 mN/m or less can be more increased than in the first embodiment, thus achieving much higher repellency.

Next, a method of producing the liquid repellent structure 40 of this embodiment will be described.

FIGS. 10A to 10F are schematic sectional views illustrating the method of producing the liquid repellent structure according to the third embodiment of the present invention in order of steps.

The steps shown in FIGS. 10A to 10D in this embodiment are the same as those in the method of producing the liquid repellent structure 10 of the first embodiment shown in FIGS. 5A to 5D, so their detailed description will be omitted. Therefore, the step shown in FIG. 10E will be first described below in detail.

Figure 10A:
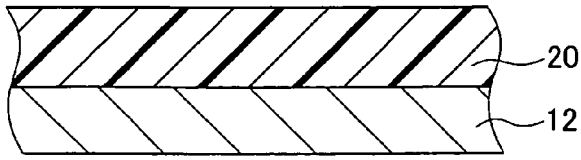
FIGS. 10A to 10F are schematic sectional views illustrating a method of producing the liquid repellent structure according to the third embodiment of the present invention in order of steps.
Figure 10B:
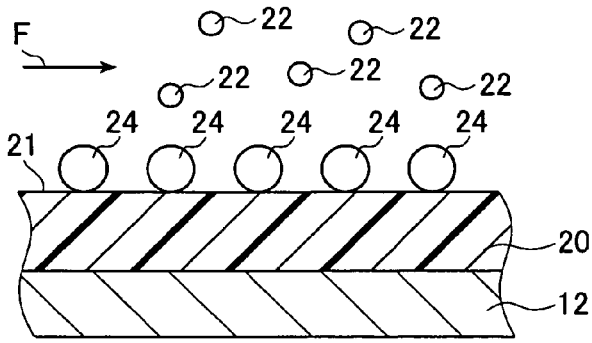
Figure 10C:
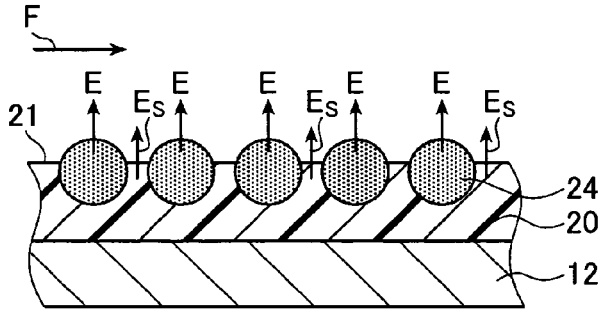
Figure 10D:
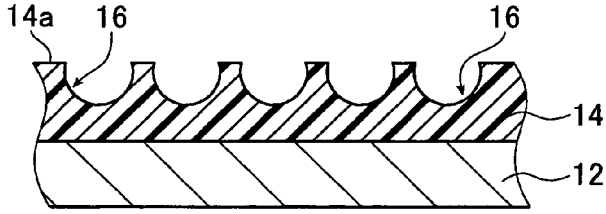
Figure 10E:
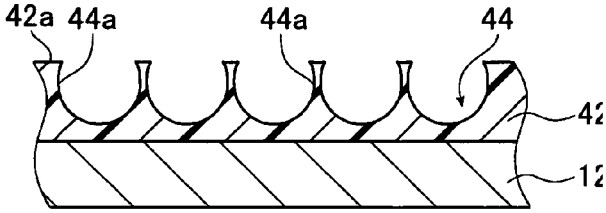

In this embodiment, the honeycomb-patterned film 14 having the recesses 16 formed at the surface 14*a* is subjected to, for example, oxygen plasma etching or wet etching, whereby the recesses 16 of the honeycomb-patterned film 14 are enlarged to form the honeycomb-patterned film (second honeycomb-patterned film) 42 having the enlarged recesses 44 as shown in FIG. 10E.

Figure 10F:
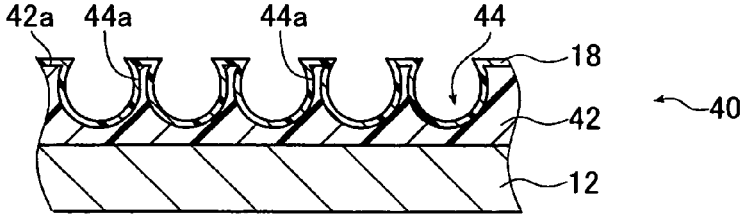

Next, as shown in FIG. 10F, the coating 18 is formed on the surface 42*a* of the honeycomb-patterned film 42 and inner surfaces 44*a* of the recesses 44 in the same manner as in the liquid repellent structure 10 of the first embodiment.

As in the first embodiment, the coating 18 is formed by a method selected from, for example, spin coating, a forming method that involves evaporating a fluorine-containing material by heating, CVD, sputtering, vacuum deposition and vapor adsorption. The liquid repellent structure 40 of this embodiment can be thus produced.

The method of producing the liquid repellent structure 40 of this embodiment has the same effects as those in the first embodiment. More specifically, the method of producing the liquid repellent structure 40 of this embodiment also does not employ photolithography, so patterning is not necessary, resulting in a reduced number of steps. Therefore, the liquid repellent structure 40 can be easily produced at low cost in a short period of time.

There is also a method in which the support 12 on which the honeycomb-patterned film (second honeycomb-patterned film) 42 has been formed is immersed in a film deposition solution containing an organic solvent for film deposition and a fluorine-containing material for a predetermined period of time, after which the immersed support 12 is taken out of the film deposition solution, rinsed with the organic solvent for film deposition and dried to form the coating 18.

Figure 11A:
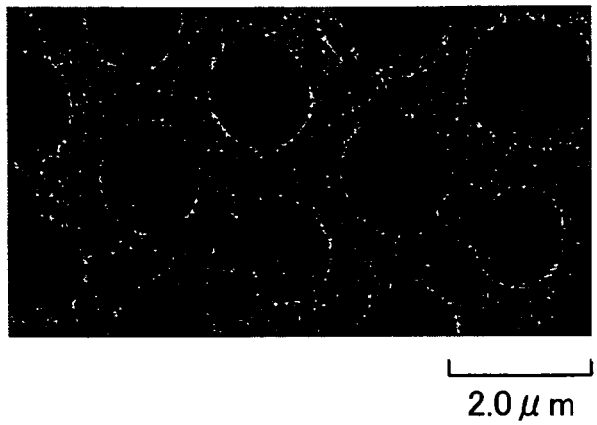
FIG. 11A shows an image of a honeycomb-patterned film shown in FIG. 10D as taken with a scanning electron microscope (SEM)
Figure 11B:
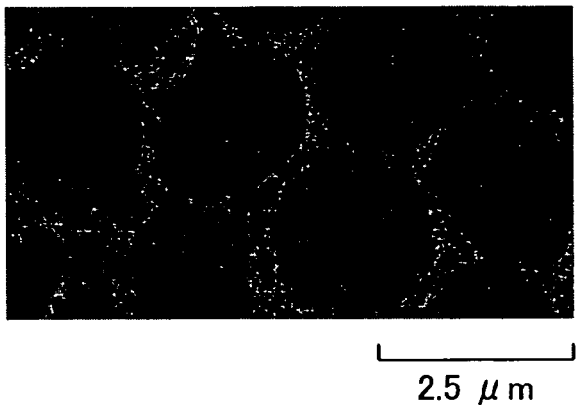
FIG. 11B shows an SEM image of a honeycomb-patterned film shown in FIG. 10F.

FIG. 11A shows an image of the honeycomb-patterned film 14 shown in FIG. 10D as taken with a scanning electron microscope (SEM), and FIG. 11B shows an SEM image of the honeycomb-patterned film 42 shown in FIG. 10F. In other words, FIG. 11A shows an SEM image taken before the coating 18 is formed in the liquid repellent structure 10 shown in FIG. 4, and FIG. 11B shows an SEM image of the liquid repellent structure 40 shown in FIG. 9.

In this embodiment, plasma etching serves to thin the lateral walls between adjacent recesses thus enlarging the recesses, as shown in FIGS. 11A and 11B.

Next, a modified example of the third embodiment of the present invention will be described.

Figure 12:
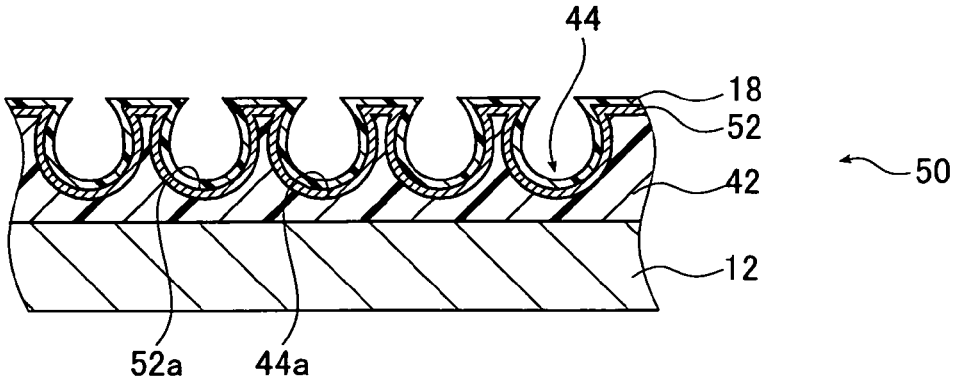
FIG. 12 is a schematic sectional view showing a modified example of the liquid-repellent structure according to the third embodiment of the present invention.

FIG. 12 is a schematic sectional view showing the modified example of the liquid repellent structure according to the third embodiment of the present invention. The same components as those in the liquid repellent structure 40 of the third embodiment of the present invention as shown in FIG. 9 are identified by the same reference numerals and their description will be omitted.

A liquid repellent structure 50 of this modified example has the same construction as that of the liquid repellent structure 40 of the third embodiment (see FIG. 9) except that the surface 42*a* of the honeycomb-patterned film 42 is covered with a reinforcing layer 52, whose surface 52*a* is then covered with the coating 18, so its detailed description will be omitted.

In the liquid repellent structure 50 of the modified example, the reinforcing layer 52 is made of an inorganic material such as glass or a metallic material. The reinforcing layer 52 is formed in the same manner as the coating 18 so as to have a sufficient thickness to maintain the shape of the recesses 44 of the honeycomb-patterned film 42. In addition, since the coating 18 is formed on the surface 52*a* of the reinforcing layer 52, the reinforcing layer 52 and the coating 18 preferably have a sufficient total thickness to maintain the shape of the recesses 44 of the honeycomb-patterned film 42.

The liquid repellent structure 50 of the modified example is provided with the reinforcing layer 52, which enables the liquid repellent structure 50 to achieve the same effects as those in the liquid repellent structure 40 of the third embodiment, while further enhancing the strength and durability.

In this modified example, the coating 18 may be formed by the following procedure: The support 12 on which the reinforcing layer 52 has been formed is immersed in a film deposition solution containing an organic solvent for film deposition and a fluorine-containing material for a predetermined period of time, after which the immersed support 12 is taken out of the film deposition solution, rinsed with the organic solvent for film deposition and dried to form the coating 18.

The liquid repellent structure of the present invention may be used in, for example, a mold for electroforming. By using the support in a film shape, the liquid repellent structure of the present invention may also be provided on a curved surface, a tube inner surface or the like, so that high repellency can be imparted to the place where the liquid repellent structure is provided. There is no particular limitation on the shape of the place where the liquid repellent structure of the present invention is to be provided, but high repellency can be imparted to any desired place.

Next, a fourth embodiment of the present invention will be described.

This embodiment is directed to an electrostatic inkjet recording apparatus in which the liquid repellent structure according to any one of the first to third embodiments is applied to an ejection substrate of a liquid ejection head.

Figure 13:
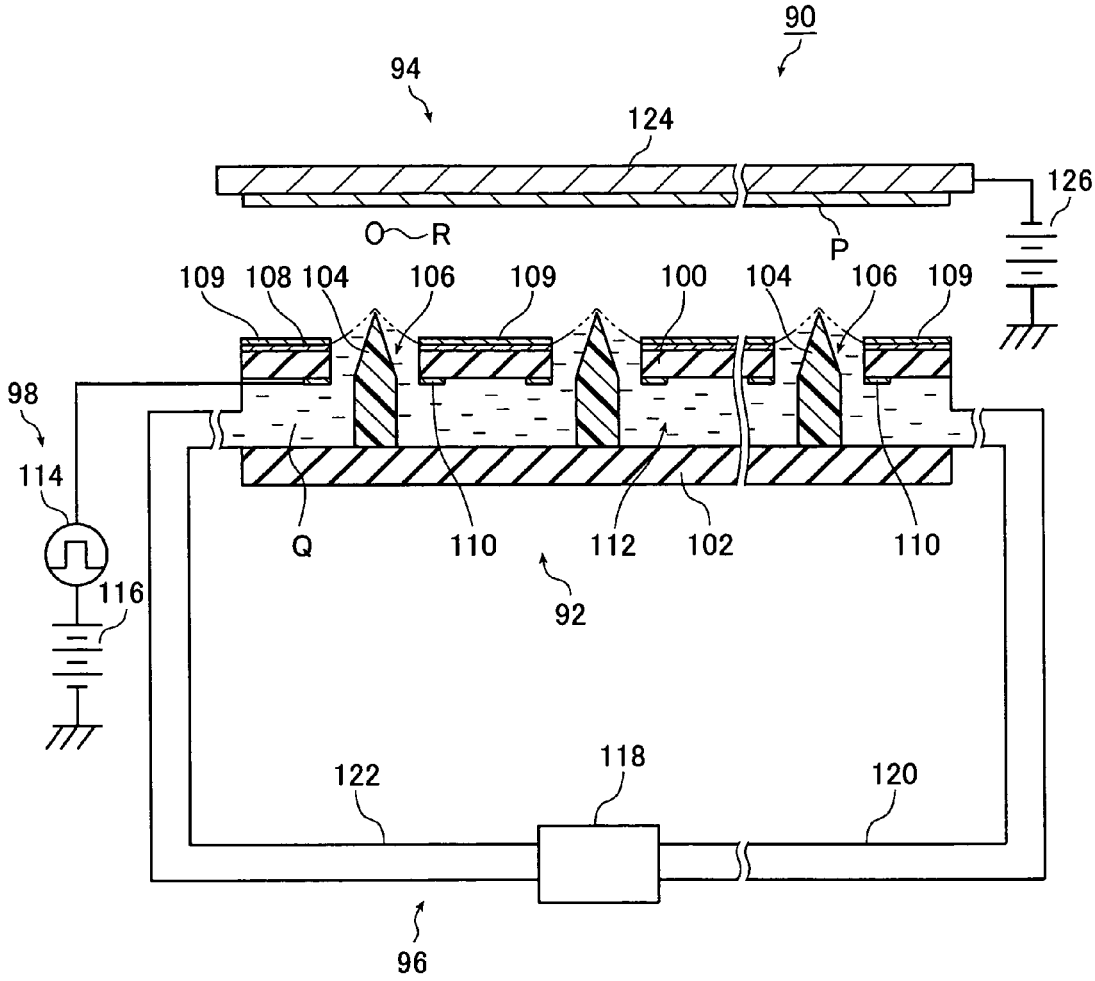
FIG. 13 is a schematic sectional view showing an inkjet recording apparatus which has an electrostatic inkjet head and in which the liquid repellent structure of the present invention is applied to an ejection substrate of a liquid ejection head.
Figure 14:
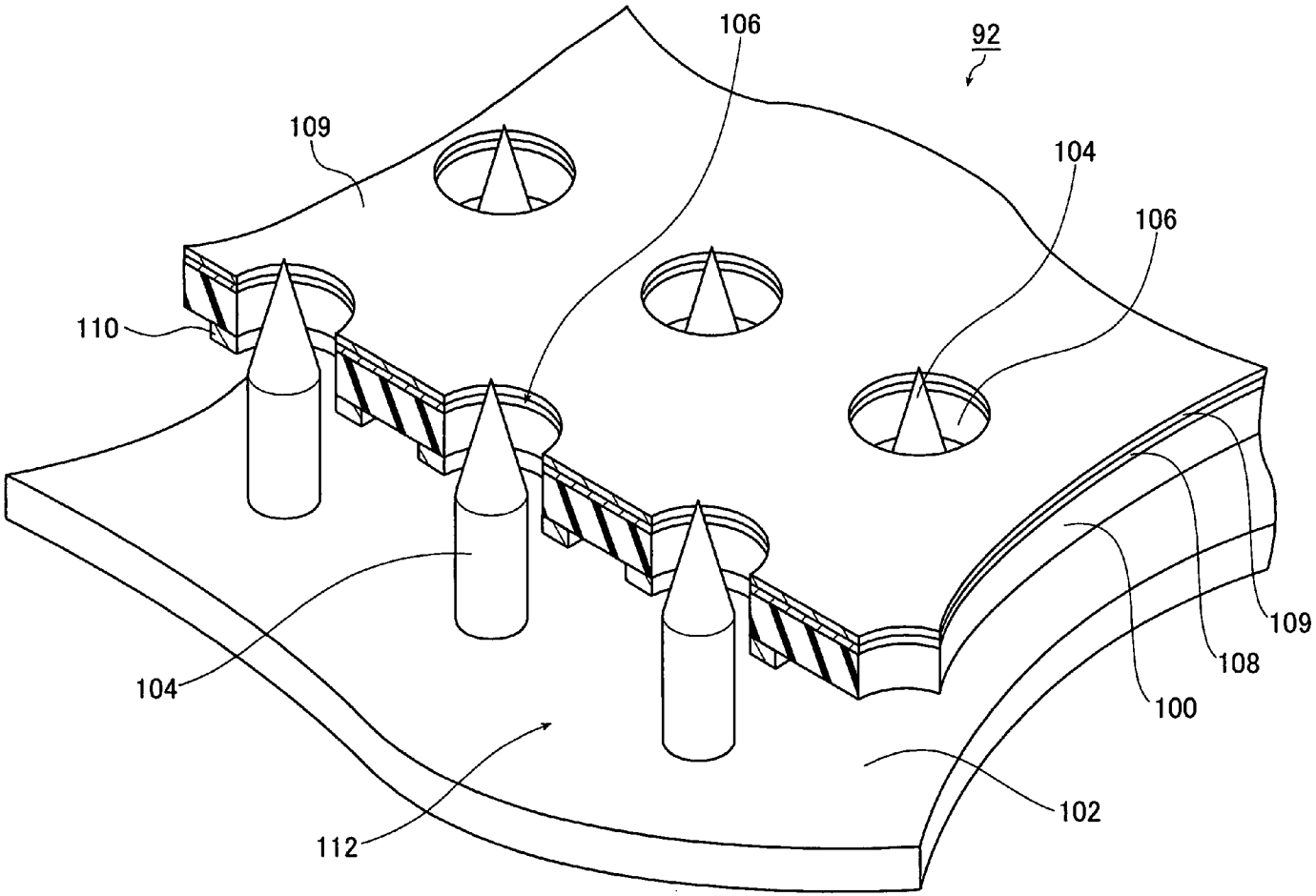
FIG. 14 is a schematic partial perspective view of the liquid ejection head shown in FIG. 13.

FIG. 13 is a schematic sectional view showing an inkjet recording apparatus which has an electrostatic inkjet head and in which the liquid repellent structure of the present invention is applied to an ejection substrate of a liquid ejection head. FIG. 14 is a schematic partial perspective view of the liquid ejection head shown in FIG. 13.

An inkjet recording apparatus (hereinafter referred to as a recording apparatus) 90 shown in FIG. 13 ejects ink droplets R by electrostatic ink droplet ejection means to record (draw) an image on, for example, a rectangular recording medium P. The apparatus 90 basically includes a liquid ejection head (hereinafter referred to as an ejection head) 92 of the present invention; means 94 for holding the recording medium P; an ink circulating system 96; and voltage applying means 98.

In the recording apparatus 90 of this embodiment, the ejection head 92 is a so-called line head that has lines of ejection orifices 106 for the ink droplets R, each line corresponding to the entire region of one side of the recording medium P. These lines are hereinafter referred to as the nozzle lines.

In the recording apparatus 90, while holding the recording medium P so as to face the ejection head 92 and regulating it at a predetermined recording position, the holding means 94 moves it (transports it for scanning) in a direction perpendicular to the nozzle lines of the ejection head 92 to two-dimensionally scan the entire surface of the recording medium P with the nozzle lines. In synchronization with the scanning, the ink droplets R are ejected from the respective ejection orifices 106 of the ejection head 92 through modulation in accordance with an image to be recorded, whereby an image is recorded on the recording medium P in a drop-on-demand manner.

Upon recording of the image, the ink circulating system 96 circulates ink Q through a predetermined circulating path including the ejection head 92 (ink flow path 112 to be described later) to supply the ink Q to the respective ejection orifices 106.

The ejection head 92 is a liquid ejection head of an electrostatic inkjet recording apparatus that ejects the ink Q (the ink droplets R) by virtue of an electrostatic force. As shown in FIGS. 13 and 14, the ejection head 92 basically includes an ejection substrate 100, a support substrate 102, and ink guides (solution guides) 104.

The ejection substrate 100 is a substrate made of an insulating material such as a ceramic material (e.g., $Al_2O_3$ or $ZrO_2$) or polyimide, and is perforated with a large number of through-holes serving as the ejection orifices 106 for ejecting the ink Q as the ink droplets R.

In a preferred form, the other region than the ejection orifices 106 on the upper surface of the ejection substrate 100 (surface on the droplet ejection side or the recording medium P side; this side is hereinafter referred to as the upper side and the opposite side as the lower side) is entirely coated with a shield electrode 108. A liquid repellent layer 109 is formed on the surface of the shield electrode 108. The surface of the liquid repellent layer 109 serves as an ink ejection surface (solution ejection surface).

The shield electrode 108 is a sheet-like electrode that is formed from a conductive metal plate or the like and is common to all the ejection orifices 106, and is kept at a predetermined potential. The predetermined potential includes 0 V through grounding. The shield electrode 108 allows an ejection orifice 106 (ejection portion) to be shielded from the electric lines of force of the adjacent ejection orifices 106 (ejection portions) to prevent electric field interference between the ejection portions, so that the ink droplets R can be consistently ejected.

Any one of the liquid repellent structures of the first to third embodiments described above is applicable to the liquid repellent layer 109 of the recording apparatus that has the electrostatic inkjet head. Therefore, the liquid repellent layer 109 need only have the same construction as that of any one of the liquid repellent structures of the first to third embodiments.

Ejection electrodes 110 are provided on the lower surface of the ejection substrate 100 for the respective ejection orifices 106.

In this embodiment, each of the ejection electrodes 110 is, for example, a ring-shaped electrode that surrounds each ejection orifice 106, and is connected to the voltage applying means 98.

The voltage applying means 98 includes a driving power source 114 and a bias power source 116 connected in series. The side of the voltage applying means 98 having the same polarity as that of the charged colorant particles of the ink Q (e.g., positive electrode) is connected to each ejection electrode 110 and the other side is grounded.

The driving power source 114 is, for example, a pulsed power source, and supplies a pulsed drive voltage modulated in accordance with an image to be recorded (image data=ejection signal) to each ejection electrode 110. The bias power source 116 applies a predetermined bias voltage to each ejection electrode 110 at all times during recording of an image.

The support substrate 102 is also a substrate formed of an insulating material such as polyimide or glass.

The ejection substrate 100 is at a predetermined distance from the support substrate 102, and the gap therebetween serves as the ink flow path 112 for supplying the ink Q to each ejection orifice 106.

The ink flow path 112 is connected to the ink circulating system 96 to be described later. The ink circulating system 96 circulates the ink Q through a predetermined path so that the ink Q flows in the ink flow path 112 (for example, right to left in this embodiment) to be supplied to each ejection orifice 106.

The ink guides 104 are disposed on the upper surface of the support substrate 102.

The ink guides 104 guide the ink Q supplied from the ink flow path 112 to the ejection orifices 106 toward their upper portions to adjust the shape or size of a meniscus to thereby stabilize the meniscus while concentrating an electric field (electrostatic force) on each ejection orifice and hence on the meniscus, whereby the ink droplets R are easily ejected. The ink guides 104 are disposed for the respective ejection orifices 106 so as to extend through the ejection orifices 106 to project from the surface of the ejection substrate 100 toward the recording medium P (holding means 94) side.

An ejection orifice 106, an ejection electrode 110, and an ink guide 104 corresponding to one another form one ejection portion (one channel) for the ejection of the ink droplet R for one dot and the tip of each ink guide 104 is set as the ejection position of the ink Q.

In the ejection head 92 of this embodiment, each ink guide 104 has, for example, a cylindrical portion on the lower side (base side) whose center coincides with that of the corresponding ejection electrode 110, and a conical portion on the upper side (tip side). The portion of the ink guide 104 that has the maximum diameter is slightly smaller than the inner diameter of the ejection electrode 110. A metal may be vapor-deposited onto the tip of the ink guide 104 to concentrate the electric field thereon.

The ink circulating system 96 supplies the ink to the ink flow path 112 formed between the ejection substrate 100 and the support substrate 102.

The ink circulating system 96 includes ink supply means 118 having an ink tank for containing the ink Q and a pump for supplying the ink Q; an ink supply flow path 120 for connecting the ink supply means 118 with the ink inlet of the ink flow path 112 (located at the right end of the ink flow path 112 in FIG. 13); and an ink recovery flow path 122 for connecting the ink outlet of the ink flow path 112 (located at the left end of the ink flow path 112 in FIG. 13) with the ink supply means 118. The system may also include means for replenishing the ink tank with ink or other means.

The ink Q is circulated along the following route: At first, the ink is supplied from the ink supply means 118 to the ink flow path 112 of the ejection head 92 through the ink supply flow path 120. Then, the ink flows in the ink flow path 112 (from right to left in FIG. 13). Then, the ink returns from the ink flow path 112 to the ink supply means 118 through the ink recovery flow path 122. In this way, the ink is supplied from the ink flow path 112 to the respective ejection orifices 106 (nozzles).

Various types of ink (solutions) which is used for electrostatic inkjet printing and is prepared by dispersing charged fine particles in a dispersion medium, as exemplified by the ink prepared by dispersing charged particles containing a colorant in a dispersion medium can be used for the ink Q to be ejected from the ejection head 92 of the present invention. The ink Q is, for example, a liquid having a surface tension of 40 mN/m or less, and hence has a surface tension lower than that of water.

The holding means 94 holds the recording medium P and transports the medium for scanning in the direction perpendicular to the direction in which the nozzle lines of the ejection head 92 are arranged. This direction is hereinafter referred to as the scanning direction.

The holding means 94 includes a counter electrode 124 serving also as a platen for holding the recording medium P while facing the upper surface (solution ejection surface) of the ejection head 92 (the ejection substrate 100); a counter bias power source 126; and scan/transport means (not shown) that transports the recording medium P for scanning in the scanning direction by moving the counter electrode 124 in the scanning direction. The ejection orifices 106 (nozzle lines) of the ejection head 92 are used to two-dimensionally scan the entire surface of the recording medium P which is transported for scanning, and the ink droplets R are ejected from the respective ejection orifices 106 in a modulated manner to form an image.

There is no particular limitation on the means for holding the recording medium P with the counter electrode 124, but conventional methods such as a method involving the use of static electricity, a method involving the use of a jig, and a method based on suction are usable.

The counter bias power source 126 applies a bias voltage opposite in polarity to each ejection electrode 110 (or colorant particles) to the counter electrode 124. The opposite side of the counter bias power source 126 is grounded.

Image recording with the recording apparatus 90 will be described below.

Upon recording of an image, the ink circulating system 96 circulates the ink Q, which causes the ink to be supplied to each ejection orifice 106.

Upon recording of an image, the bias power source 116 applies a bias voltage of, for example, 100 V to each ejection electrode 110. Furthermore, the recording medium P is held on the counter electrode 124, and the counter bias power source 126 applies a bias voltage of, for example, −1,000 V to the counter electrode 124. Therefore, a bias voltage corresponding to 1,100 V is applied between the ejection electrode 110 and the counter electrode 124 (recording medium P), and an electric field (static electricity) corresponding to the bias voltage is generated therebetween.

The ink Q has a meniscus formed in each ejection orifice 106 based on, for example, circulation of the ink Q, static electricity generated by the bias voltage, the surface tension and the capillary action of the ink Q, and the action of each ink guide 104. In addition, colorant particles (positively charged particles in this embodiment) migrate toward each ejection orifice 106 (i.e., meniscus) to concentrate the ink Q. The concentration causes the meniscus to further grow. When a balance is achieved between the surface tension of the ink Q and, for example, static electricity, the meniscus is stabilized.

In this embodiment, the liquid repellent layer 109 is formed on the surface of the shield electrode 108, so the ink Q whose surface tension is lower than that of water such as an organic solvent, oil, or a liquid having a surface tension of 40 mN/m or less can exhibit repellency. Therefore, the meniscus can be further stabilized.

In this state, when the driving power source 114 applies a drive voltage of, for example, 200 V to each ejection electrode 110, static electricity acting on the ink Q and its meniscus increases and the concentration of the ink Q at the meniscus is promoted. As a result, the meniscus abruptly grows, and the ink Q having concentrated colorant particles are ejected as the ink droplets R at the time the growing power of the meniscus, the force with which the colorant particles are transferred to the meniscus, and the attracting force from the counter electrode 124 exceed the surface tension of the ink Q.

The ejected ink droplets R are sprayed owing to the momentum at the time of ejection and the attracting force from the counter electrode 124 to strike on the recording medium P thereby forming an image.

Since the ink ejection surface of the ejection head 92 of this embodiment includes the liquid repellent layer 109 having the liquid repellent structure of the present invention, the contact angle can be increased to 90° or more, or be increased to some extent although the contact angle is not more than 90° with respect to not only water but also the ink Q whose surface tension is lower than that of water like an organic solvent, oil, or a liquid having a surface tension of 40 mN/m or less, and the meniscus shape is stabilized. Therefore, the direction in which the ink droplets R are sprayed becomes constant, and the ink droplet R always strikes on the recording medium P at the position corresponding to the center of the projecting tip of each ink guide, so the ink droplet R is allowed to strike on the recording medium P at the correct position. As a result, a high-quality image can be recorded on the recording medium P. Furthermore, stabilized meniscus shape ensures ejection of an ink droplet R of a predetermined size (predetermined amount) to enable a good image with stabilized densities to be recorded on the recording medium P.

In this embodiment, the electrostatic inkjet recording apparatus in which the liquid repellent structure of the present invention is applied to the ejection substrate of the liquid ejection head has been described. However, the present invention is not limited thereto, and the structure is applicable to any recording apparatus having a liquid ejection head. The present invention is applicable to one having piezoelectric or thermal droplet ejection means, as exemplified by a piezoelectric inkjet recording apparatus or a thermal inkjet recording apparatus.

Next, a fifth embodiment of the present invention will be described.

Figure 15A:
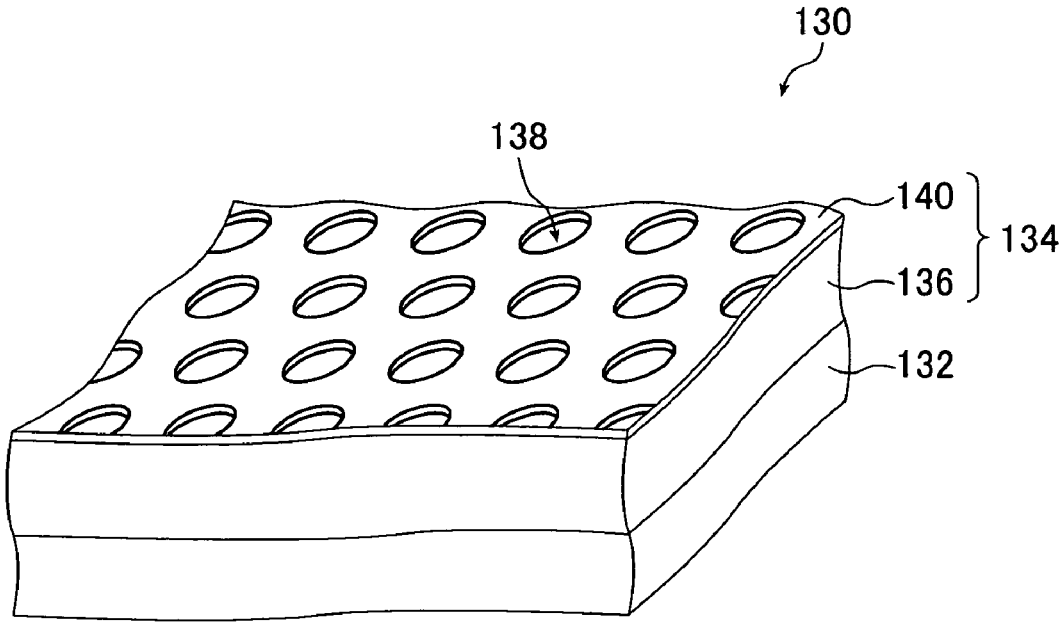
FIG. 15A is a schematic perspective view showing a protective film including a stain-resistant layer to which the liquid repellent structure of the present invention is applied.
Figure 15B:
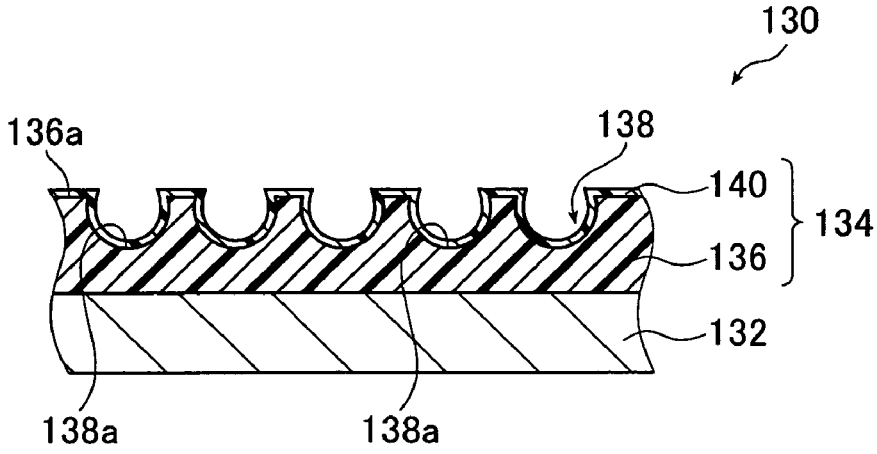
FIG. 15B is a schematic partial sectional view of the protective film shown in FIG. 15A.

FIG. 15A is a schematic perspective view showing a protective film including a stain-resistant layer to which the liquid repellent structure of the present invention is applied and FIG. 15B is a schematic partial sectional view of the protective film shown in FIG. 15A.

A protective film 130 of this embodiment is obtained by applying the liquid repellent structure according to any one of the first to third embodiments described above to a stain-resistant layer 134.

The protective film 130 shown in FIGS. 15A and 15B includes a support base 132; and the stain-resistant layer 134 formed on a surface of the support base 132.

The support base 132 is formed from, for example, a transparent plastic film. Examples of the material that may be used for the support base 132 include cellulose ethers such as triacetyl cellulose, diacetyl cellulose, and propionyl cellulose; and polyolefins such as polypropylene, polyethylene, and polymethylpentene.

The stain-resistant layer 134 has a base 136 having recesses 138 formed at its surface 136*a* and a coating 140 formed on the surface 136*a* of the base 136 and all inner surfaces 138*a* of the recesses 138.

The stain-resistant layer 134 shown in FIGS. 15A and 15B has the same construction as that of the liquid repellent structure 10 of the first embodiment (see FIG. 4) in which the coating 18 is formed on the surface 14*a* of the honeycomb-patterned film 14.

The liquid repellent structure according to any one of the first to third embodiments described above is applicable to the stain-resistant layer 134 of this embodiment. Therefore, the stain-resistant layer 134 need only have the same construction as that of the liquid repellent structure according to any one of the first to third embodiments described above.

In the protective film 130 of this embodiment, the stain-resistant layer 134 has the same construction as that of the liquid repellent structure 10 according to the first embodiment described above (see FIG. 4), so the stain-resistant layer 134 exhibits high repellency with respect to not only water but also a liquid having a surface tension lower than that of water such as an organic solvent, oil, or a liquid having a surface tension of 40 mN/m or less. Therefore, oil that is a main component of stains is not readily adhered to the surface of the stain-resistant layer 134. Stains can be thus prevented from being caused by adhesion of fingerprints, sebum, sweat, cosmetics and the like and even if they cause stains, the stains can be easily removed.

As described above, the protective film 130 of this embodiment can prevent stains from being caused by fingerprints, sebum, sweat, cosmetics and the like, and hence be advantageously used for, for example, a touch panel or a filter to be attached to the surface of any one of various monitors.

The liquid repellent structure and the method of producing the same, the liquid ejection head and the protective film according to the present invention have been described above. However, the present invention is not limited to the above embodiments and it should be understood that various improvements and modifications may be made without departing from the scope and spirit of the present invention.

EXAMPLES

The present invention will be described below in further detail by way of specific examples of the liquid repellent structure of the present invention. It should be understood that the present invention is not limited to the following examples. Example 1 will be first described.

Example 1

In Example 1, honeycomb-patterned films (repellency increasing structures) of Example Nos. 1 and 2 to be described below were produced and evaluated for their repellency.

Poly(ϵ-caprolactone) was used to form the honeycomb-patterned film in Example No. 1 as shown in FIGS. 10D and 11A.

The honeycomb-patterned film in Example No. 1 was further subjected to oxygen plasma etching and fluorocarbon coating with a fluoroalkylsilane to form the repellency increasing structure in Example No. 2 as shown in FIGS. 9 and 11B.

In Example 1, oxygen plasma etching was performed to thin the lateral walls between adjacent recesses thus enlarging the recesses as shown in FIGS. 11A and 11B.

Comparative Example 1

For comparison with Example No. 1, a flat surface that was made of poly(ϵ-caprolactone) and had no irregularities was used (Comparative Example No. 1).

The flat surface made of poly(ϵ-caprolactone) was further subjected to oxygen plasma etching and fluorocarbon coating with a fluoroalkylsilane to form another flat surface having no irregularities, which was used for comparison with Example No. 2 (Comparative Example No. 2). The rows of "flat" shown in Table 2 show the results obtained from the flat surfaces in Comparative Example Nos. 1 and 2.

Water having a surface tension of 72 mN/m, 13 wt % aqueous isopropanol (IPA) solution having a surface tension of 35 mN/m, 30 wt % aqueous isopropanol (IPA) solution having a surface tension of 27 mN/m, decane having a surface tension of 23 mN/m, and silicone oil having a surface tension of 18 mN/m were dripped onto the flat surfaces in Comparative Example Nos. 1 and 2 and the honeycomb-patterned films in Example Nos. 1 and 2, and the results of the contact angles therebetween are shown in Table 2. The contact angle was measured with a contact angle meter manufactured by Kyowa Interface Science Co., Ltd.

| | Water (72 mN/m) Contact angle | 13% aqueous IPA solution (35 mN/m) Contact angle | 30% aqueous IPA solution (27 mN/m) Contact angle | Decane (23 mN/m) Contact angle | Silicone oil (18 mN/m) Contact angle |
|---|---|---|---|---|---|
| Ex. No. 1 (honeycomb) | 110° | 94° | 64° | 0° | 0° |
| Ex. No. 2 (honeycomb) | 133° | 127° | 121° | 115° | 100° |
| Comp. Ex. No. 1 (flat) | 88° | 53° | 36° | 0° | 0° |
| Comp. Ex. No. 2 (flat) | 120° | 93° | 85° | 57° | 40° |

In Comparative Example No. 1, the flat surface formed a contact angle of 88° with respect to water owing to the properties inherent in the poly(ϵ-caprolactone) material, whereas the contact angle was increased to 110° in the honeycomb structure of Example No. 1, thus enhancing the repellency. This effect was achieved by the porous structure such as the honeycomb structure. However, in both of Example No. 1 and Comparative Example No. 1, the contact angles were abruptly decreased with respect to decane and silicone oil having low surface tensions, and the repellency was lost.

On the other hand, in Example No. 2, the contact angle with respect to water was 133° and hence was larger than in Example No. 1. A contact angle of at least 100° was also obtained with respect to decane and silicone oil having low surface tensions and a very large contact angle was thus obtained. Such a large contact angle is due to increased pore size through etching and coating of the surface with a fluorine-containing material (fluoroalkylsilane). The flat surface as in Comparative Example No. 2 that did not have a porous structure such as the honeycomb structure formed a contact angle of not more than 90° and exhibited no repellency, whereas repellency was enhanced in the porous structure such as the honeycomb structure coated with a fluorine-containing material owing to the effect of air inclusion in the porous structure.

Example 2

Next, Example 2 of the present invention will be described.

Various liquids having different surface tensions (water, an aqueous IPA solution having a concentration of 0.5 to 30 wt %, hexadecane, decane, heptane, octane, silicone oil, and a mixed liquid for the wetting tension test (manufactured by Wako Pure Chemical Industries, Ltd.) were used to measure the contact angles in Example Nos. 1 and 2 and Comparative Example Nos. 1 and 2 of Example 1 described above to thereby examine the effect of the surface structure of the present invention. The results are shown in FIGS. 16A and 16B.

Figure 16A:
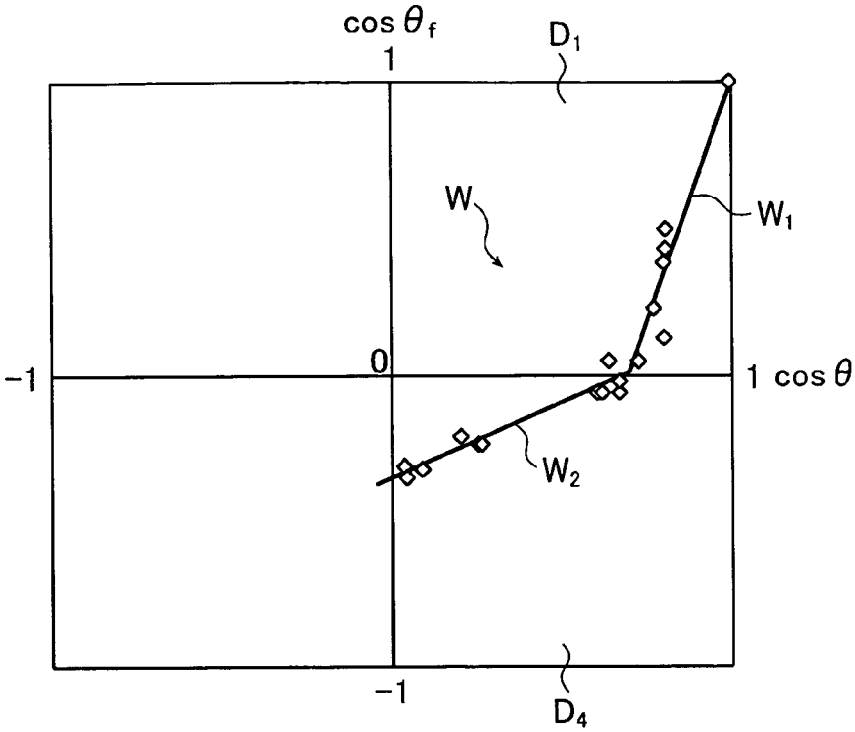
FIG. 16A is a graph showing a relationship between the contact angle on the honeycomb structure in Example No. 1 and that on a flat surface in Comparative Example No. 1 in which the axis of ordinates indicates cos $\theta_f$ and the axis of abscissas indicates cos $\theta$.
Figure 16B:
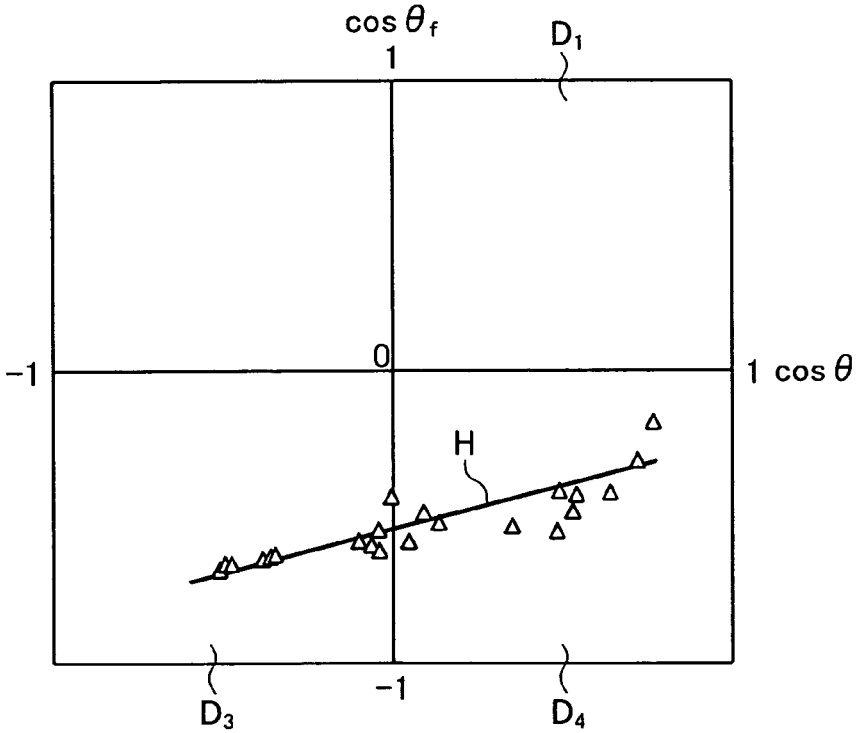
FIG. 16B is a graph showing a relationship between the contact angle on the honeycomb structure in Example No. 2 and that on a flat surface in Comparative Example No. 2 in which the axis of ordinates indicates cos $\theta_f$ and the axis of abscissas indicates cos $\theta$.
Figure 17:
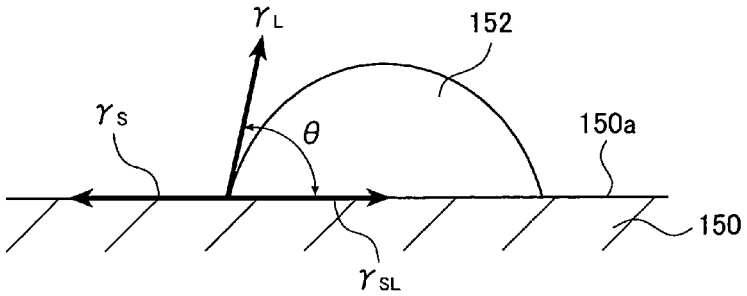
FIG.17 PRIOR ART
FIG. 17 is a schematic view showing a relationship among the surface tension of a liquid droplet dropped on a flat surface, the surface tension of a solid, the interfacial tension between the solid and the liquid droplet, and the contact angle.
Figure 18:
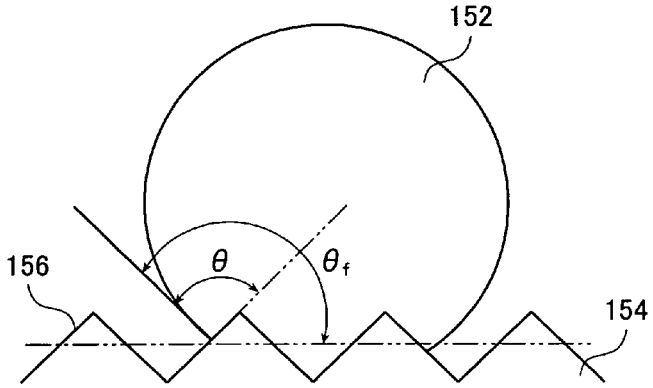
FIG.18 PRIOR ART
FIG. 18 is a schematic view showing a Wentzel model.

FIG. 16A is a graph showing a relationship between the contact angle on a flat surface in Comparative Example No. 1 and that on the honeycomb structure in Example No. 1 and FIG. 16B is a graph showing a relationship between the contact angle on a flat surface in Comparative Example No. 2 and that on the honeycomb structure in Example No. 2.

As shown in FIG. 16A, a polygonal line W in Example No. 1 can be divided into two gradients. A line $W_2$ within the fourth quadrant $D_4$ is formed according to the Cassie model and a line $W_1$ within the first quadrant $D_1$ is formed according to the Wentzel model.

The area ratio of the pores (recesses) in Example No. 1 is estimated at 34% by fitting the resulting values to the line $W_2$ of the Cassie model.

On the other hand, as shown in FIG. 16B, the resulting values are present along a line H formed according to the Cassie model. The line H is within the fourth quadrant $D_4$, which means that high repellency is exhibited with respect to a liquid having a low surface tension such as an organic solvent or oil. The area ratio of the pores (recesses) in Example No. 2 is estimated at 55% by fitting them to the line of the Cassie model and the calculation also shows that the pore area is increased as a result of oxygen plasma etching.

The liquid repellent structure (honeycomb-patterned film) having a coating made of a fluorine-containing material on its surface has been described in Examples mentioned above, but the coating on the surface of the liquid repellent structure may be made of another material so that the surface of the liquid repellent structure can have functions inherent in the coating material. For example, a platinum or titanium dioxide film may be formed on the surface of the liquid repellent structure to enhance the catalytic action so that the liquid repellent structure can be applied to an antibacterial action or decomposition of a toxic gas. In addition, a fluorine-free organic material can also achieve repellency and in particular water repellency by forming the honeycomb structure.

What is claimed is:

1. A liquid ejection head for ejecting droplets of a solution, comprising:

an ejection substrate in which through-holes are formed, said droplets being ejected through said through-holes; and droplet ejection means for ejecting said droplets of said solution from said through-holes, each of said droplet ejection means being disposed for each through-hole, wherein said ejection substrate has a liquid repellent structure so that a solution-ejection surface of said ejection substrate around said through-holes corresponds to an upper surface of said liquid repellent structure, said liquid repellent structure comprising:

a support;

a honeycomb-patterned film formed by applying a solution of an organic compound comprising a fluorine-free or non-fluorine-based polymeric compound in an organic solvent onto said support to form a solution film on said support, placing said support to form a solution film on said support, placing said support on which said solution film is formed in an atmosphere containing water vapor to form water droplets on a surface of said solution film and evaporating said organic solvent and said water droplets; and a coating film which is formed on a surface of said honeycomb-patterned film and is made of a fluorine-containing material.

2. The liquid ejection head according to claim 1 wherein said solution includes charged particles dispersed therein, wherein said droplet ejection means comprises:

ejection electrodes which are disposed for said individual through-holes and causes an electrostatic force to act on said solution; and solution guides which extend through said ejection substrate and protrude on a droplet-ejecting side of said ejection substrate, and wherein said electrostatic force from said ejection electrodes causes said droplets to be ejected.

3. The liquid ejection head according to claim 1, wherein said droplet ejection means comprises piezoelectric or thermal droplet ejection means that ejects said droplets from said respective through-holes of said ejection substrate.

4. The liquid ejection head according to claim 1, further comprising a reinforcing layer comprising a reinforcing material and formed between said honeycomb-patterned film and said coating film.

5. The liquid ejection head according to claim 4, wherein said reinforcing layer comprises an inorganic material.

6. The liquid ejection head according to claim 5, wherein said inorganic material is glass or a metallic material.

* * * * *